US010787853B2

(12) United States Patent
Wolf et al.

(10) Patent No.: US 10,787,853 B2
(45) Date of Patent: Sep. 29, 2020

(54) INTEGRATED CASEMENT WINDOW OPERATOR AND LOCK WITH ANTI-BACKDRIVE FEATURE

(71) Applicant: Truth Hardware Corporation, Owatonna, MN (US)

(72) Inventors: Glen M. Wolf, Owatonna, MN (US); Gregory J. Vetter, Owatonna, MN (US); Douglas A. Nolte, Owatonna, MN (US); Zach Pennaz, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 199 days.

(21) Appl. No.: 16/108,078

(22) Filed: Aug. 21, 2018

(65) Prior Publication Data

US 2019/0063135 A1 Feb. 28, 2019

Related U.S. Application Data

(60) Provisional application No. 62/548,260, filed on Aug. 21, 2017, provisional application No. 62/660,135, filed on Apr. 19, 2018.

(51) Int. Cl.
*E05F 11/24* (2006.01)
*E05F 11/14* (2006.01)

(52) U.S. Cl.
CPC ..... *E05F 11/145* (2013.01); *E05F 11/14* (2013.01); *E05Y 2800/116* (2013.01); *E05Y 2900/148* (2013.01)

(58) Field of Classification Search
CPC ..... E05F 11/145; E05F 11/14; E05F 11/10; E05Y 2800/116; E05Y 2800/148;
(Continued)

(56) References Cited

U.S. PATENT DOCUMENTS 1,985,655 A 12/1934 Floraday
2,050,403 A 8/1936 Weiner
(Continued)

FOREIGN PATENT DOCUMENTS

CA 2360634 A1 4/2003
CA 2460464 A1 * 9/2005 ..... E05F 11/10
(Continued)

OTHER PUBLICATIONS

Truth Hardware, Rh Single Arm Operator Assembly, Drawing, pp. 1, Jan. 28, 1993.

*Primary Examiner* — Jerry E Redman
(74) *Attorney, Agent, or Firm* — Bradley J. Thorson

(57) ABSTRACT

An integrated casement window operator and lock, including a gear mechanism and an arm assembly, the arm defining a rack portion and an adjacent arcuate gear portion, the arm mounted to the housing with a pinion gear engaged with the rack portion and the arcuate gear portion, the pinion gear defining a star-shaped aperture therethrough and a handle with a square-shaped shaft portion received in the star-shaped aperture of the gear. The handle is selectively rotatable to shift the arm between a window fully closed position and a window fully open position, wherein an anti-backdrive mechanism is provided to inhibit backdriving of the arm in both the window fully closed window fully open positions.

20 Claims, 24 Drawing Sheets

(58) Field of Classification Search
CPC ... E05C 1/12; E05C 9/12; E05C 9/021; E05C 9/041
USPC ..... 49/248, 339, 341, 342
See application file for complete search history.

(56) References Cited

U.S. PATENT DOCUMENTS

| | | | | |
|---|---|---|---|---|
| 2,082,066 | A | | 6/1937 | Lackey |
| 2,214,280 | A | | 9/1940 | Lang |
| 2,321,800 | A | | 6/1943 | Cordrey et al. |
| 2,610,054 | A | | 9/1952 | Reynaud |
| 2,635,485 | A | | 4/1953 | Gravenstine et al. |
| 2,686,669 | A | | 8/1954 | Johnson |
| 2,795,413 | A | | 6/1957 | Rodaway |
| 2,899,195 | A | | 8/1959 | Ahlgren |
| 2,926,905 | A | | 3/1960 | Ahlgren |
| 3,114,542 | A | | 12/1963 | Ahlgren |
| 3,811,715 | A | | 5/1974 | Brudy |
| 3,846,938 | A | | 11/1974 | Kelly |
| 4,037,483 | A | | 7/1977 | Nadal |
| 4,241,541 | A | | 12/1980 | Van Klompenburg et al. |
| 4,253,276 | A | | 3/1981 | Peterson et al. |
| 4,266,371 | A | | 5/1981 | Erdman et al. |
| 4,301,622 | A | | 11/1981 | Dunsmoor |
| 4,305,228 | A | | 12/1981 | Nelson |
| 4,445,794 | A | | 5/1984 | Sandberg |
| 4,497,135 | A | | 2/1985 | Vetter |
| 4,505,601 | A | | 3/1985 | Sandberg et al. |
| 4,674,149 | A | | 6/1987 | Vetter |
| 4,715,089 | A | | 12/1987 | Schema |
| 4,726,092 | A | | 2/1988 | Tachney et al. |
| 4,823,508 | A | | 4/1989 | Allen |
| 4,840,075 | A | | 6/1989 | Tucker |
| 4,843,703 | A | | 7/1989 | Nolte et al. |
| 4,845,830 | A | | 7/1989 | Nolte et al. |
| 4,860,493 | A | | 8/1989 | Lense |
| 4,887,392 | A | | 12/1989 | Lense |
| 4,894,902 | A | | 1/1990 | Tucker |
| 4,932,695 | A | | 6/1990 | Pettit et al. |
| 4,938,086 | A | | 7/1990 | Nolte et al. |
| 5,054,239 | A | | 10/1991 | Tucker et al. |
| 5,272,837 | A | | 12/1993 | Nolte et al. |
| 5,440,839 | A | | 8/1995 | Piltingsrud |
| 5,493,813 | A | | 2/1996 | Vetter et al. |
| 5,509,234 | A | * | 4/1996 | Klimek ..... E05F 11/16 49/342 |
| 5,531,138 | A | | 7/1996 | Vetter |
| 5,623,784 | A | | 4/1997 | Kuersten et al. |
| 5,634,726 | A | | 6/1997 | Edele et al. |
| 5,740,632 | A | | 4/1998 | Peterson et al. |
| 5,765,308 | A | | 6/1998 | Anderson et al. |
| 5,802,913 | A | | 9/1998 | Winner |
| 5,815,984 | A | | 10/1998 | Sheets et al. |
| 5,839,229 | A | | 11/1998 | Briggs et al. |
| 5,937,582 | A | | 8/1999 | Taylor |
| 6,044,587 | A | | 4/2000 | Vetter et al. |
| 6,076,304 | A | * | 6/2000 | Carrier ..... E05C 9/021 49/336 |
| 6,122,863 | A | | 9/2000 | Tippin et al. |
| 6,128,858 | A | | 10/2000 | Vetter et al. |
| 6,247,270 | B1 | | 6/2001 | Huml |
| 6,374,544 | B1 | | 4/2002 | Ellis |
| 6,634,141 | B2 | | 10/2003 | Anderson et al. |
| 6,640,389 | B2 | | 11/2003 | Van Klompenburg et al. |
| 6,672,010 | B1 | | 1/2004 | Gledhill et al. |
| D487,012 | S | | 2/2004 | Stoll et al. |
| 7,464,619 | B2 | | 12/2008 | Vetter |
| 8,448,996 | B2 | * | 5/2013 | Lake ..... E05B 7/00 292/111 |
| 9,772,010 | B2 | * | 9/2017 | Dodge ..... E05F 11/10 |
| 9,790,726 | B2 | * | 10/2017 | Balbo di Vinadio ... E05F 11/16 |
| 9,797,176 | B2 | * | 10/2017 | Balbo di Vinadio ... E05F 11/14 |
| 9,957,740 | B2 | * | 5/2018 | Goetze ..... E05C 9/16 |
| 10,221,607 | B2 | | 3/2019 | Gramstad |
| 2002/0061145 | A1 | | 5/2002 | Kobayashi et al. |
| 2004/0223674 | A1 | | 11/2004 | Fidziukiewicz |
| 2017/0030112 | A1 | * | 2/2017 | Kane ..... E05B 59/00 |
| 2017/0107750 | A1 | * | 4/2017 | Carrier ..... E05C 9/041 |
| 2017/0198512 | A1 | * | 7/2017 | Gramstad ..... E05F 11/12 |
| 2017/0306682 | A1 | * | 10/2017 | McInnis ..... E05F 11/10 |
| 2018/0163451 | A1 | * | 6/2018 | Erickson ..... E06B 3/325 |
| 2018/0340360 | A1 | * | 11/2018 | Nakasone ..... E05C 9/042 |
| 2019/0383069 | A1 | * | 12/2019 | Guelck ..... E05C 17/505 |

FOREIGN PATENT DOCUMENTS

| | | | |
|---|---|---|---|
| CA | 2460464 | A1 | 9/2005 |
| JP | 2002220969 | A | 8/2002 |
| WO | 9518284 | A1 | 7/1995 |

* cited by examiner

INTEGRATED CASEMENT WINDOW OPERATOR AND LOCK WITH ANTI-BACKDRIVE FEATURE

CROSS-REFERENCE TO RELATED APPLICATIONS

This application claims the benefit of U.S. Provisional Patent Application No. 62/548,260, filed Aug. 21, 2017, and entitled INTEGRATED CASEMENT WINDOW OPERATOR AND LOCK WITH ANTI-BACKDRIVE FEATURE, and also claims the benefit of U.S. Provisional Patent Application No. 62/660,135, filed Apr. 19, 2018, and entitled INTEGRATED CASEMENT WINDOW OPERATOR AND LOCK WITH ANTI-BACKDRIVE FEATURE, both said applications being fully incorporated herein by reference.

TECHNICAL FIELD

The instant invention relates to casement windows, and in particular operators and locks for casement windows.

BACKGROUND

A casement window is a window that has a sash attached to a frame with hinges so that the sash can swing in and out to close or open the opening defined by the frame. Casement windows have certain advantages over sliding windows, such as double-hung or sideways sliding windows. In particular, sliding windows can be difficult to seal against air infiltration, since the sash must slide against the air sealing gasket or weather stripping. This often means that the sliding sash is not fitted as tightly, and the materials used for sealing selected so as to avoid excessive friction and wear. Casement sashes, however, can swing into contact with the seal, thereby avoiding any friction and causing minimal wear of the seal.

A drawback of casement windows, however, is that an operator typically must be used. An example of a typical operator used with a casement is disclosed in U.S. Pat. No. 7,464,619, said patent being hereby fully incorporated herein by reference. Such complex operators add expense and complexity to the window. Further, casement windows typically have separate locking systems to provide security against unauthorized access. These systems can add complexity to window operation as well as expense. These factors have led to casement windows being used less frequently in low-cost construction.

Prior attempts have been made to provide a simple integrated casement operator that incorporates both operation and locking functions in a single device. An example is the device described in. U.S. patent application Ser. No. 15/403,466, now U.S. Pat. No. 10,221,607, entitled INTEGRATED CASEMENT WINDOW OPERATOR AND LOCK, hereby fully incorporated herein by reference. Drawbacks of this device, however, are that it can be prone to back-driving thereby enabling unauthorized access through the window, and the hook arrangement for securing the locking point detracts from the aesthetic appearance of the device.

What is still needed in the industry is a simple casement operator that integrates the locking function in one device and that addresses the drawbacks identified above.

SUMMARY

Embodiments of the present invention address the need in the industry is a simple casement operator that integrates the locking function in one device and that addresses the drawbacks identified above including providing anti-backdriving features. According to an embodiment, an integrated casement window operator and lock includes a gear mechanism, the gear mechanism including a housing, a pinion gear rotatably mounted to the housing, and an arm assembly including an arm and a sash interface link. The arm defines a rack portion and an adjacent arcuate gear portion, and the arm is slidably and rotatably mounted to the housing with the pinion gear engaged with the rack portion and the arcuate gear portion. The pinion gear defines a star-shaped aperture therethrough, the star-shaped aperture defined by a plurality of inwardly facing surfaces, each of the inwardly facing surfaces comprising a pair of bearing surfaces on opposite sides of a central ridge. The gear further defines a pair of spaced-apart slots, the slots extending outwardly from a separate one of the pair of bearing surfaces of one of the inwardly facing surfaces. The housing defines an arc-shaped slot with notches at opposing ends of the arc-shaped slot.

The device further includes a pair of anti-backdrive pin assemblies, each of the anti-backdrive pin assemblies slidably disposed in a separate one of the spaced-apart slots of the gear and including an anti-backdrive pin, each of the anti-backdrive pins engaged in the arc-shaped slot. A handle defines a square-shaped shaft portion, the square-shaped shaft portion received in the star-shaped aperture of the gear, wherein the handle is selectively movable to rotate the pinion gear such that the arm is shifted between a window fully closed position and a window fully open position, wherein when the arm is in the fully closed position, the pin of a first one of the pair of anti-backdrive pin assemblies is engaged in one of the notches of the arc-shaped slot to inhibit backdriving of the arm, and when the arm is in the fully open position, the pin of a second one of the pair of anti-backdrive pin assemblies is engaged in the other one of the notches of the arc-shaped slot to inhibit backdriving of the arm. The square-shaped shaft portion of the handle is rotatable in the star-shaped aperture of the gear to shift the anti-backdrive assemblies out of engagement with the notches.

In an embodiment, at least one biasing spring is arranged to urge the anti-backdrive pins into engagement with the notches. The at least one biasing spring may be a leaf spring.

In an embodiment, a pair of biasing springs is arranged to urge the anti-backdrive pins into engagement with the notches. Each one of the pair of biasing springs may be a coil spring, or the pair of biasing springs may be formed as a portion of an actuating ring.

In an embodiment, the anti-backdrive pin assemblies may include a follower portion and a pin portion. The follower portion may have a wedge-shaped end.

In an embodiment, the square-shaped shaft portion of the handle defines four faces, one of the four faces defining a pair of spaced apart notches, the wedge-shaped ends of the follower portions being engageable in the notches in the face.

In an embodiment, a casement window includes a frame defining an opening, a sash received in the frame and hinged to the frame to selectively close the opening, and a window operator and lock. The window operator and lock includes a gear mechanism, the gear mechanism including a housing, a pinion gear rotatably mounted to the housing, and an arm assembly including an arm and a sash interface link. The arm defines a rack portion and an adjacent arcuate gear portion, and the arm is slidably and rotatably mounted to the housing with the pinion gear engaged with the rack portion and the arcuate gear portion. The pinion gear defines a star-shaped aperture therethrough, the star-shaped aperture defined by a plurality of inwardly facing surfaces, each of the inwardly facing surfaces comprising a pair of bearing surfaces on opposite sides of a central ridge. The gear further defines a pair of spaced-apart slots, the slots extending outwardly from a separate one of the pair of bearing surfaces of one of the inwardly facing surfaces. The housing defines an arc-shaped slot with notches at opposing ends of the arc-shaped slot.

The operator further includes a pair of anti-backdrive pin assemblies, each of the anti-backdrive pin assemblies slidably disposed in a separate one of the spaced-apart slots of the gear and including an anti-backdrive pin, each of the anti-backdrive pins engaged in the arc-shaped slot. A handle defines a square-shaped shaft portion, the square-shaped shaft portion received in the star-shaped aperture of the gear, wherein the handle is selectively movable to rotate the pinion gear such that the arm is shifted between a window fully closed position and a window fully open position, wherein when the arm is in the fully closed position, the pin of a first one of the pair of anti-backdrive pin assemblies is engaged in one of the notches of the arc-shaped slot to inhibit backdriving of the arm, and when the arm is in the fully open position, the pin of a second one of the pair of anti-backdrive pin assemblies is engaged in the other one of the notches of the arc-shaped slot to inhibit backdriving of the arm. The square-shaped shaft portion of the handle is rotatable in the star-shaped aperture of the gear to shift the anti-backdrive assemblies out of engagement with the notches.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1A:
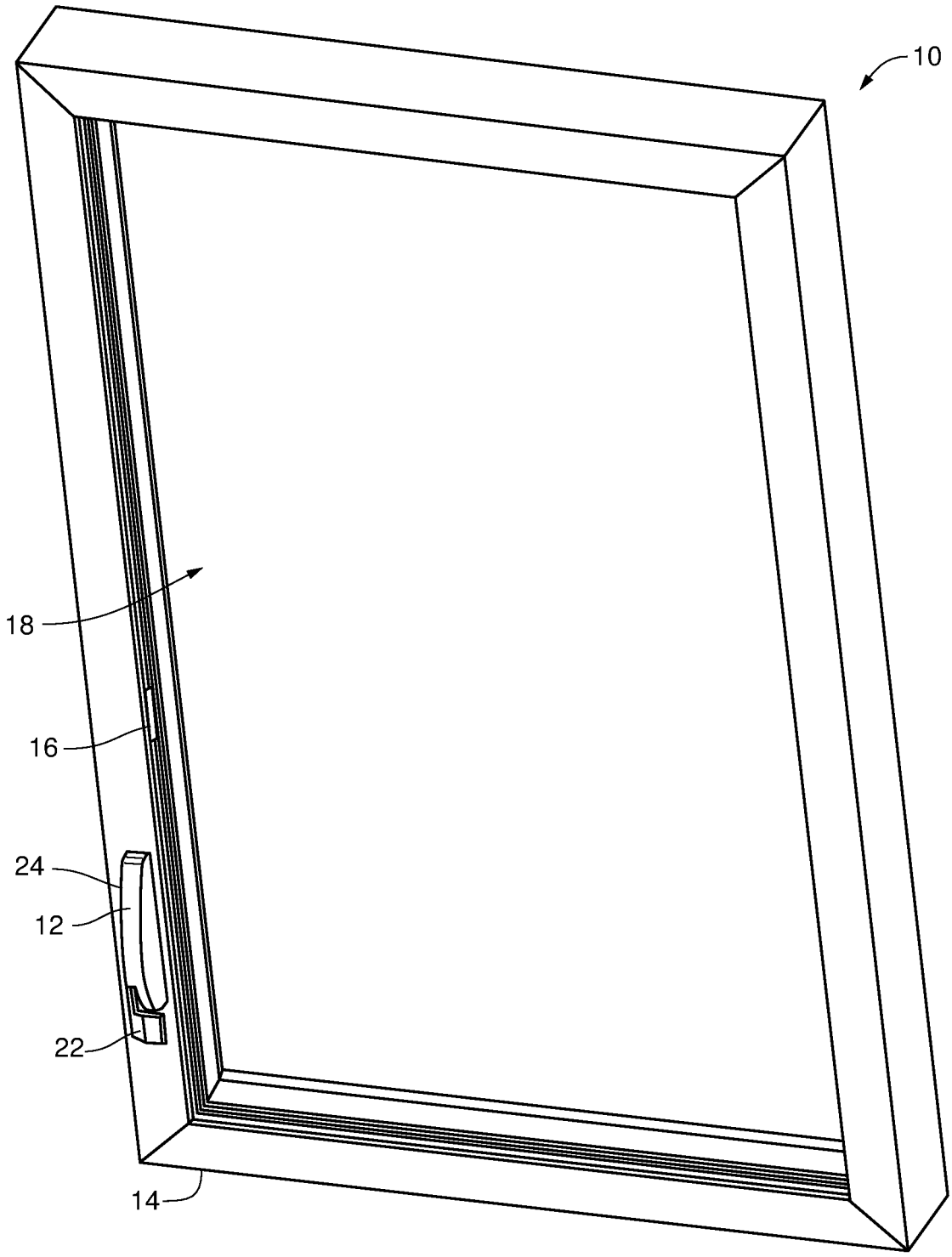
FIG. 1*a* depicts a casement window and integrated operator according to an embodiment of the invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

In FIG. 1*a*, there is depicted a typical casement window 10 with an integrated operator and lock 12 according to an embodiment of the invention. Casement window 10 generally includes frame 14 and sash 16. Frame 14 defines opening 18. Sash 16 is mounted to frame 14 with hinges (not depicted), and can be selectively swung to open and close opening 18.

Integrated operator and lock 12 is depicted in FIGS. 1-21. Integrated operator and lock 12 generally includes gear mechanism 20, handle 22, and cover 24. Gear mechanism generally includes housing 101, comprised of housing halves 100, 102, pinion gear 104, and arm assembly 106. Housing half 100 defines channel 108 and guide pin 110. Housing half 102 can define a channel (not depicted) corresponding to channel 108 and an aperture 109 corresponding to guide pin 110.

Housing half 100 further defines arc-shaped channel 112, and housing half 102 defines a corresponding arc-shaped channel (not depicted). Mating pins 114 defined by housing half 100 are received in apertures 116 in housing half 100. Arc shaped channel 112 has notches 118 at each end.

Figure 6:
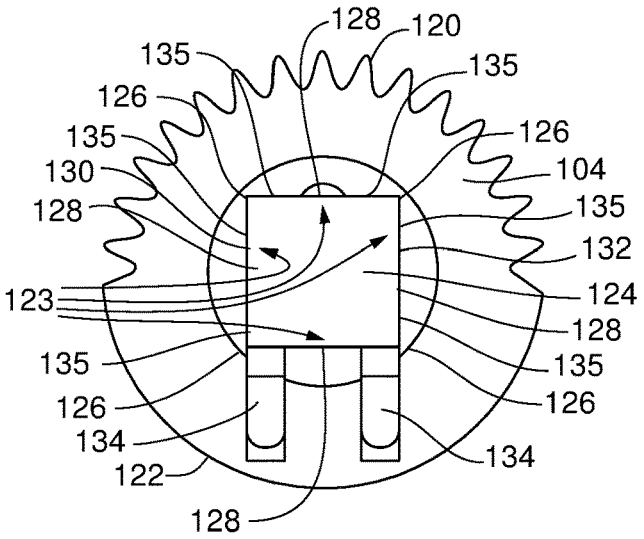
FIG. 6 a side elevation view of the gear portion of the integrated operator of FIG. 1.
Figure 23:
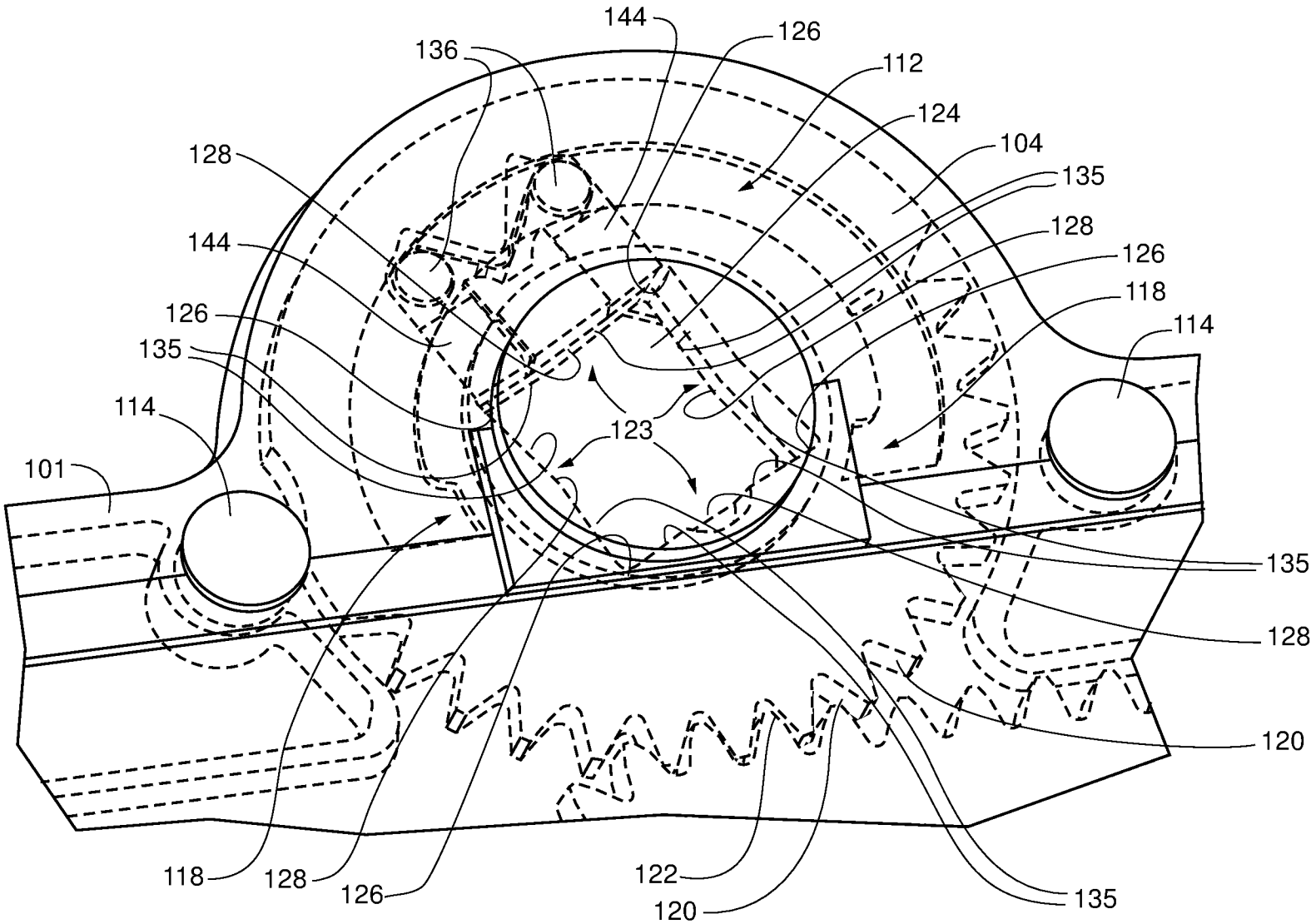
FIG. 23 depicts the gear portion of the embodiment of FIG. 22.
Figure 24:
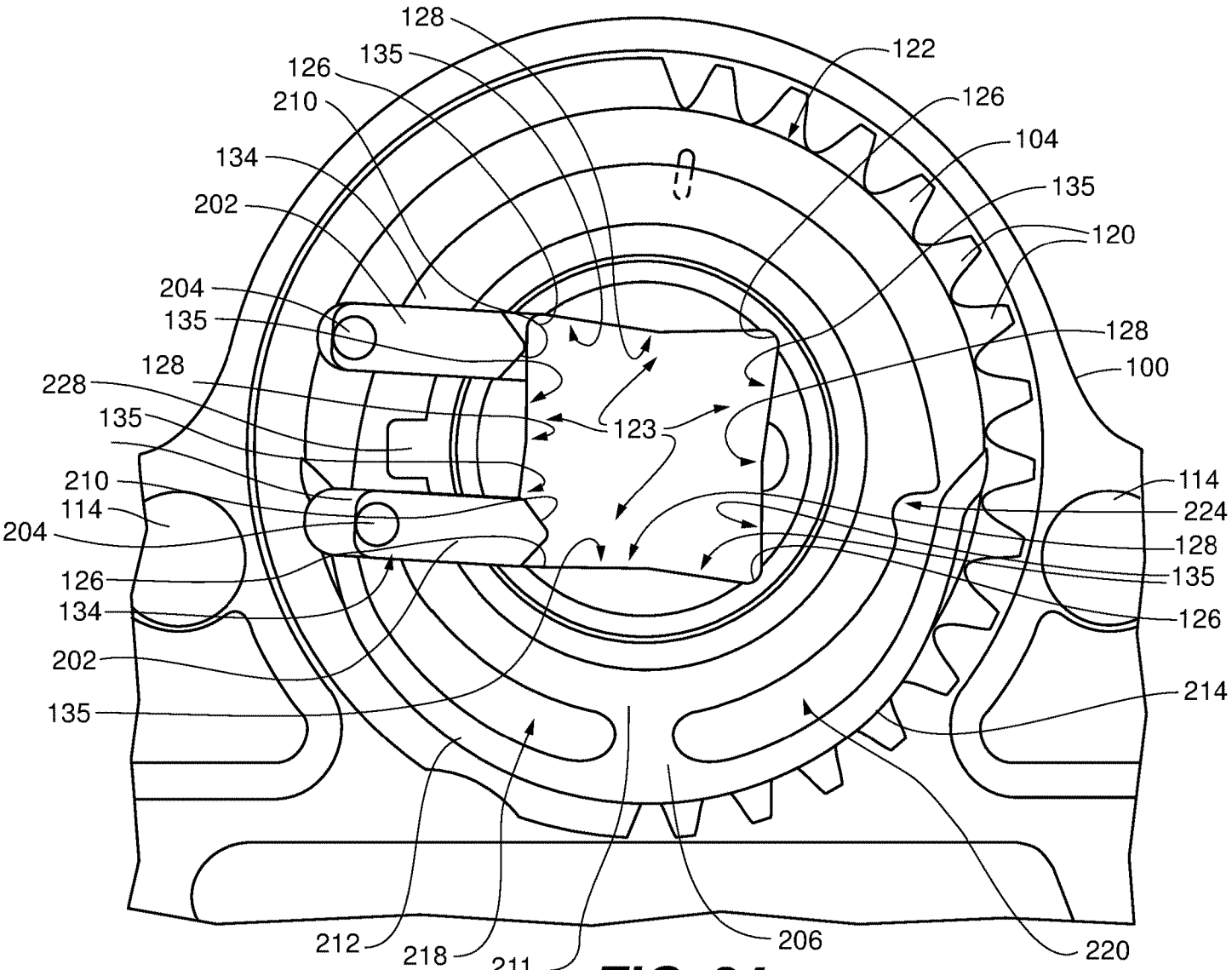
FIG. 24 is a plan view depiction of the gear portion of another alternative embodiment of the invention.
Figure 25:
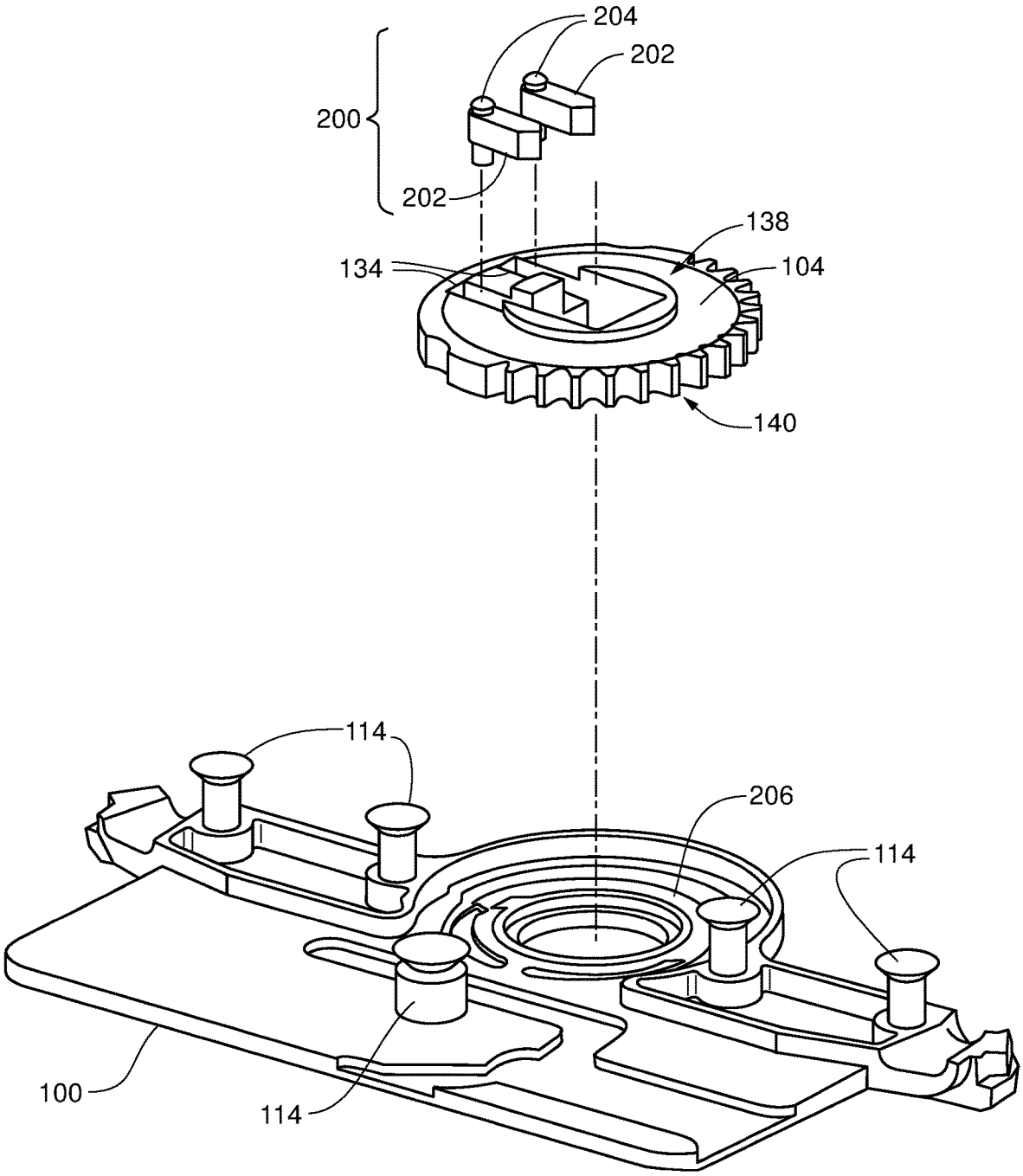
FIG. 25 is an exploded view of the embodiment of FIG. 24.

Gear 104 defines teeth 120 along a portion of periphery 122. Star-shaped aperture 124 is defined through the center of gear 104 by inwardly facing surfaces 123. Referring to FIGS. 6 and 23, corners 126 of aperture 124 are relieved, forming a central ridge 128 in each of sides 130, 132, of aperture 124. Parallel slots 134 extend outwardly from aperture 124 toward periphery 122. Bearing surfaces 135 are formed on opposite sides of central ridge 128.

Figure 1:
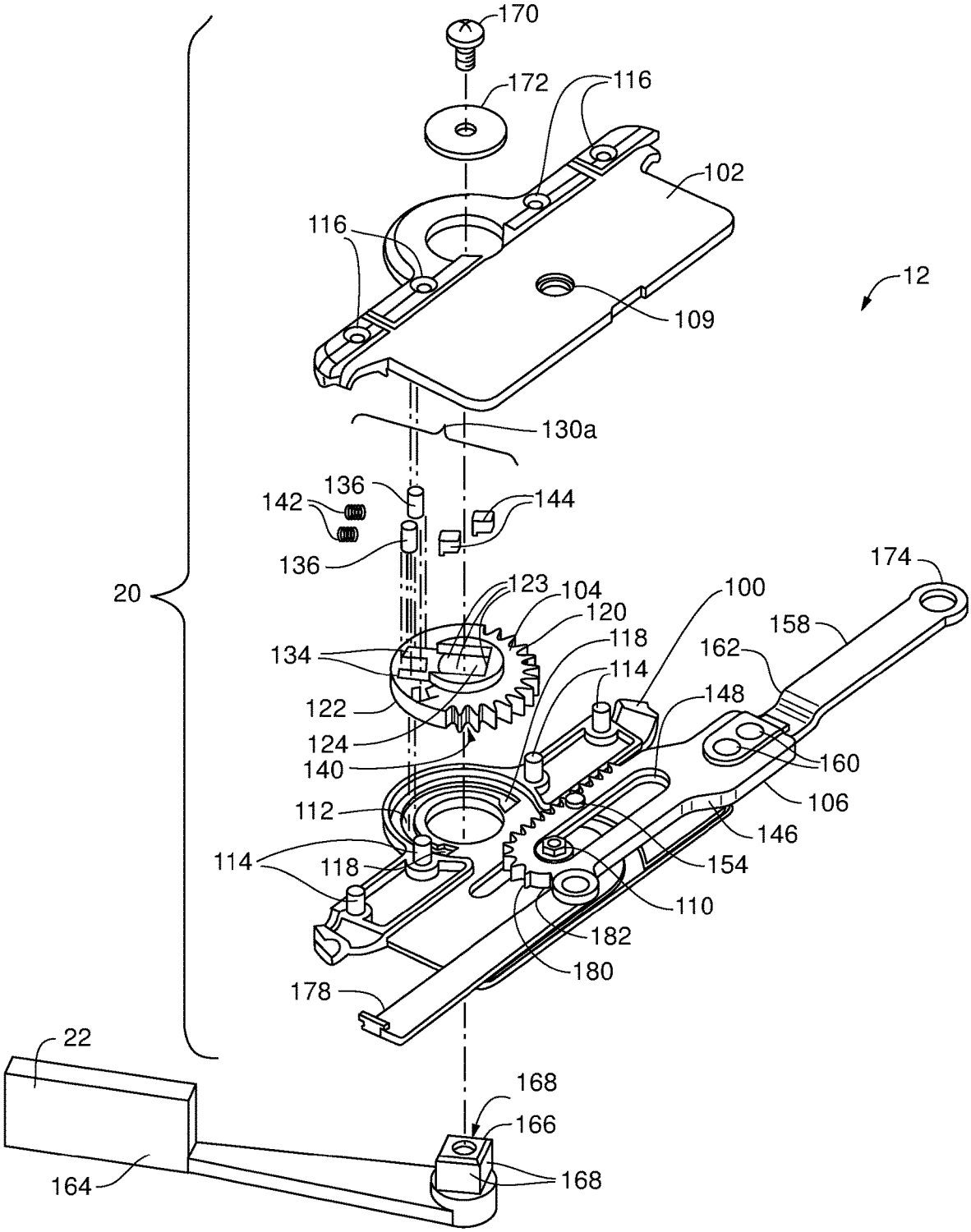
FIG. 1 is a partial exploded view of the integrated operator depicted in FIG. 1*a;*
Figure 22:
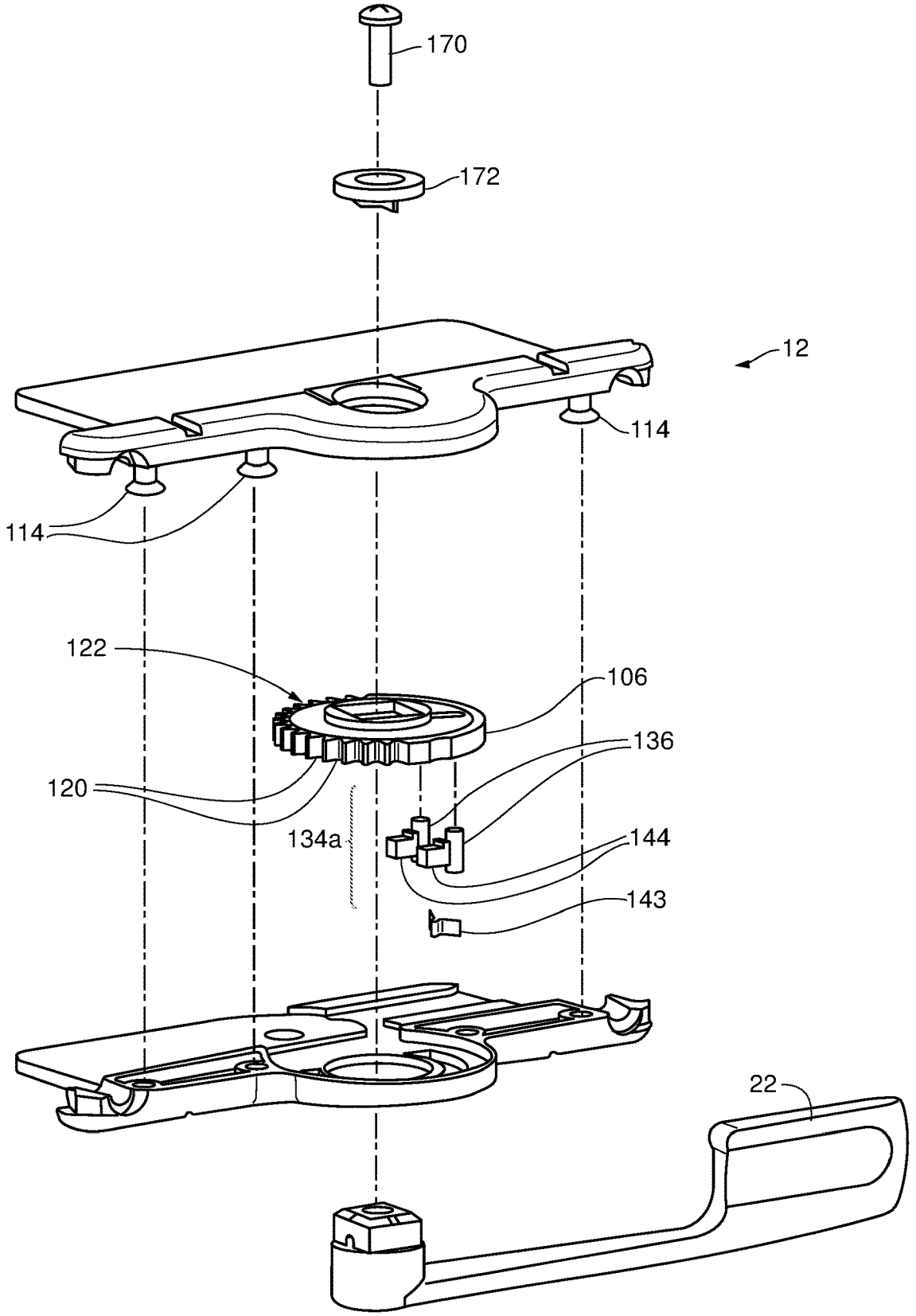
FIG. 22 is an exploded view of an alternative embodiment of an integrated operator in which the anti-backdrive pins are urged by a single leaf spring.

An anti-backdrive feature is provided through anti-back-drive assembly 134*a*. Anti-backdrive assembly 134*a* generally includes anti-backdrive pins 136, biasing springs 142, and follower blocks 144. Anti-backdrive assemblies 134*a* are received in slots 134, with anti-back-drive pins 136 extending outwardly from each face 138, 140, of gear 104. Biasing springs 142 are provided to bias anti-back-drive pins 136 toward aperture 124. Biasing springs 142 can be coil springs as depicted in FIG. 1, or can be any other type of biasing element that is effective to bias pins 136, such as leaf spring 143 depicted in FIGS. 22 and 23. Follower blocks 144 are provided on the inner end of each slot 134 and are slidable in slots 134 with anti-back-drive pins 136, with, or against, the bias of springs 142. Anti-back-drive pins 136 ride in arc-shaped channel 112 of housing half 100 and/or housing half 102.

Arm assembly 106 generally includes arm body 146 defining elongate aperture 148. Gear teeth 150 are defined along a portion of peripheral edge 152. Guide pin 154 extends outwardly and rides in channel 156 of housing half 100. Guide pin 110 of housing half 100 extends through elongate aperture 148. Arm extension 158 is fixedly coupled to arm body 146 with rivets 160, and defines boss 162.

Handle 22 generally includes finger grip portion 164 and square shaped shaft 166 presenting bearing faces 168. Square shaped shaft 166 extends through star-shaped aperture 124 of gear 104 and is secured in place with screw 170 and washer 172. It will be appreciated that bearing faces 168 contact central ridges 128, but that the star-shape of aperture 124 enables shaft 166 to rotate slightly in each direction within aperture 124 before bearing faces 168 contact bearing surfaces 135. In a preferred embodiment, the amount of this rotation is about 7.5 degrees.

Integrated operator and lock 12 is assembled with gear 104 rotatably received between housing halves 100, 102, as depicted in FIG. 1. Anti-back-drive pins 136 are received in arc-shaped channel 112. Arm assembly 106 is received between housing halves 100, 102, with guide pin 110 through elongate aperture 148 and guide pin 154 engaged in channel 156. Gear teeth 150 are meshed with teeth 120 of gear 104.

Figure 5:
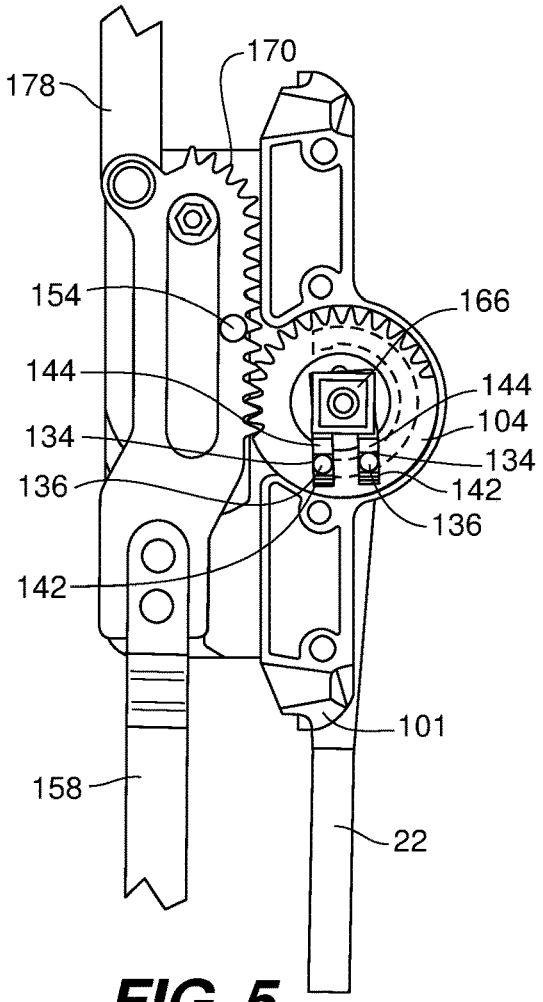
FIG. 5 is a side elevation view of the integrated operator of FIG. 1 in a window closed position with the gear portion engaged with the anti-back-drive mechanism engaged to prevent rotation.
Figure 7:
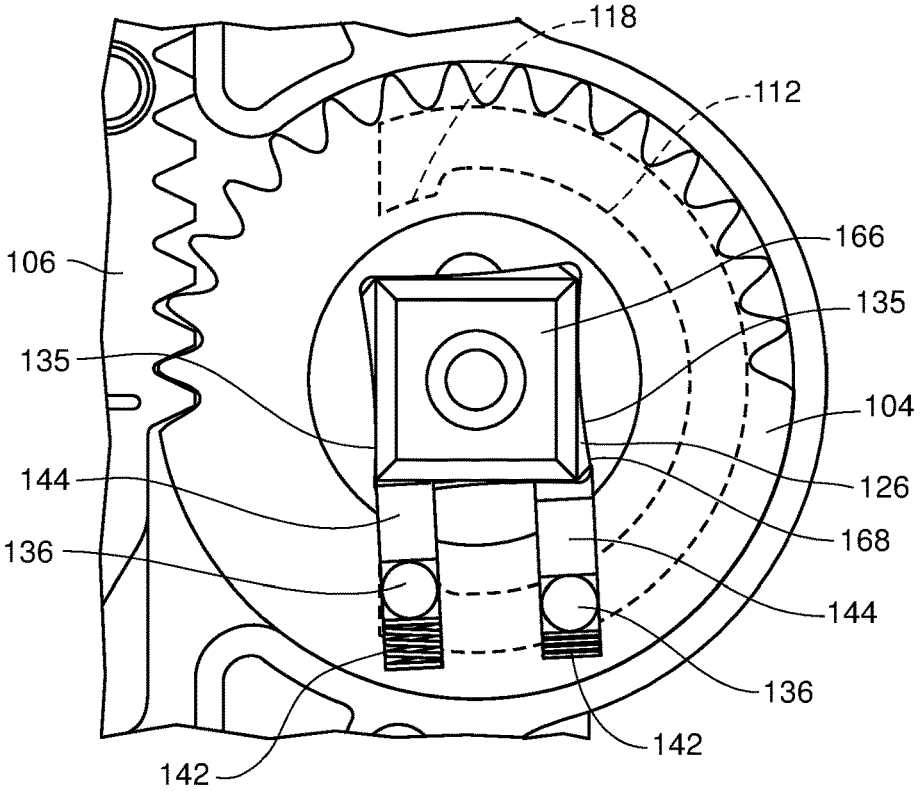
FIG. 7 is a side elevation view of the gear portion of the integrated operator of FIG. 1 with the anti-back-drive mechanism engaged to prevent rotation.
Figure 18:
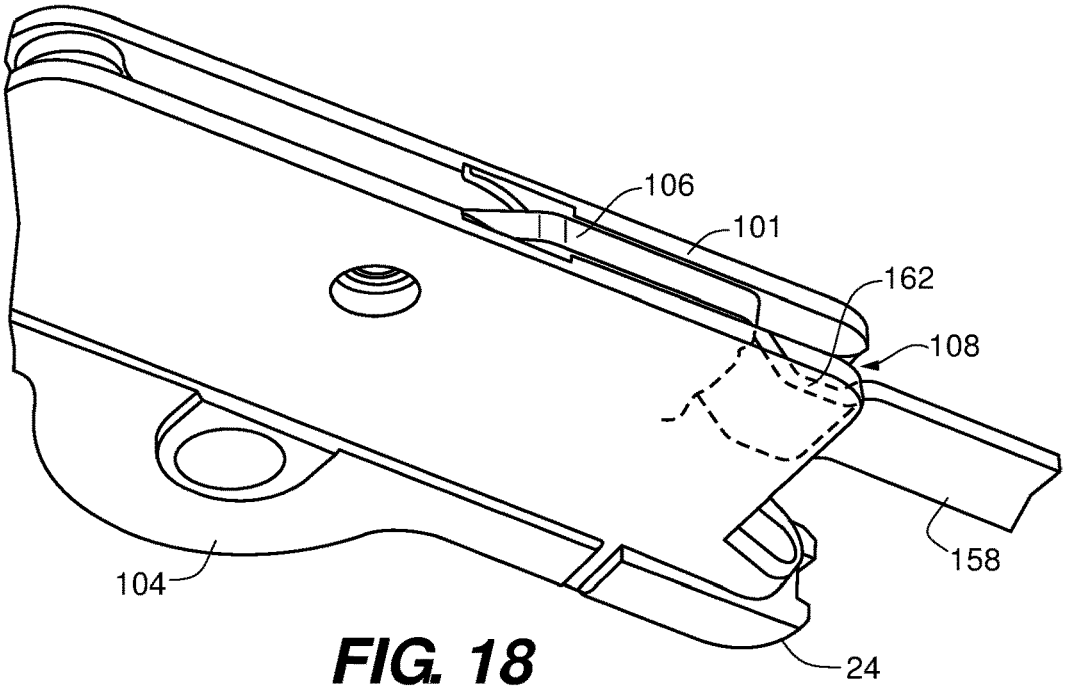
FIG. 18 is a partial isometric view of the integrated operator of FIG. 1 with a portion of the housing depicted in phantom to show engagement of the arm in a slot in the housing.
Figure 19:
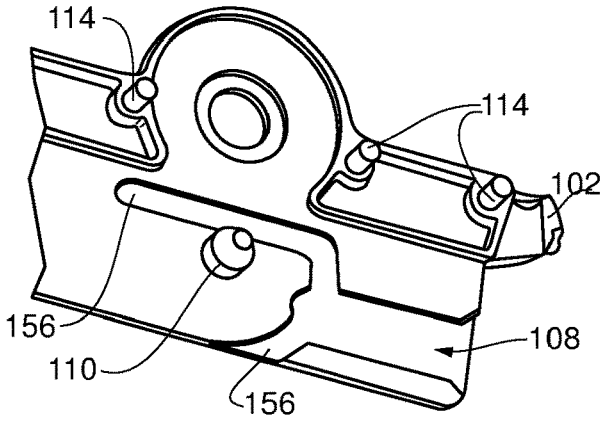
FIG. 19 is a partial isometric view of a portion of the housing of the integrated operator of FIG. 1.
Figure 21:
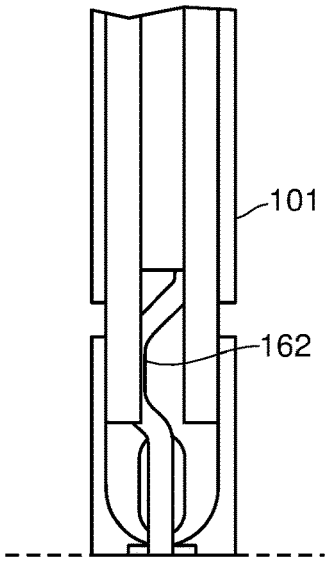
FIG. 21 is a partial sectional view of the integrated operator of FIG. 1.
Figure 20:
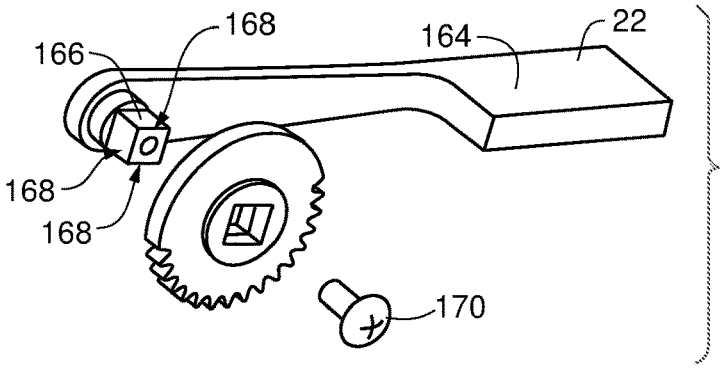
FIG. 20 is an isometric view of the handle assembly of the integrated operator of FIG. 1.

In use, integrated operator and lock 12 is mounted on frame 14 of window 10 with end 174 of arm extension 158 coupled to sash 16. In a window closed and locked position as depicted in FIGS. 5, 18, and 21, boss 162 of arm extension 158 is drawn into channel 108, thereby inhibiting arm 106 from swinging outward and locking sash 16 in a closed position in frame 14. As depicted in FIG. 7, one of anti-back-drive pins 136 is lodged in notch 118 by the bias of spring 142, thereby preventing rotation of gear 104 to open sash 16, except as initiated by rotation of handle 22 as will be described below.

Figure 2:
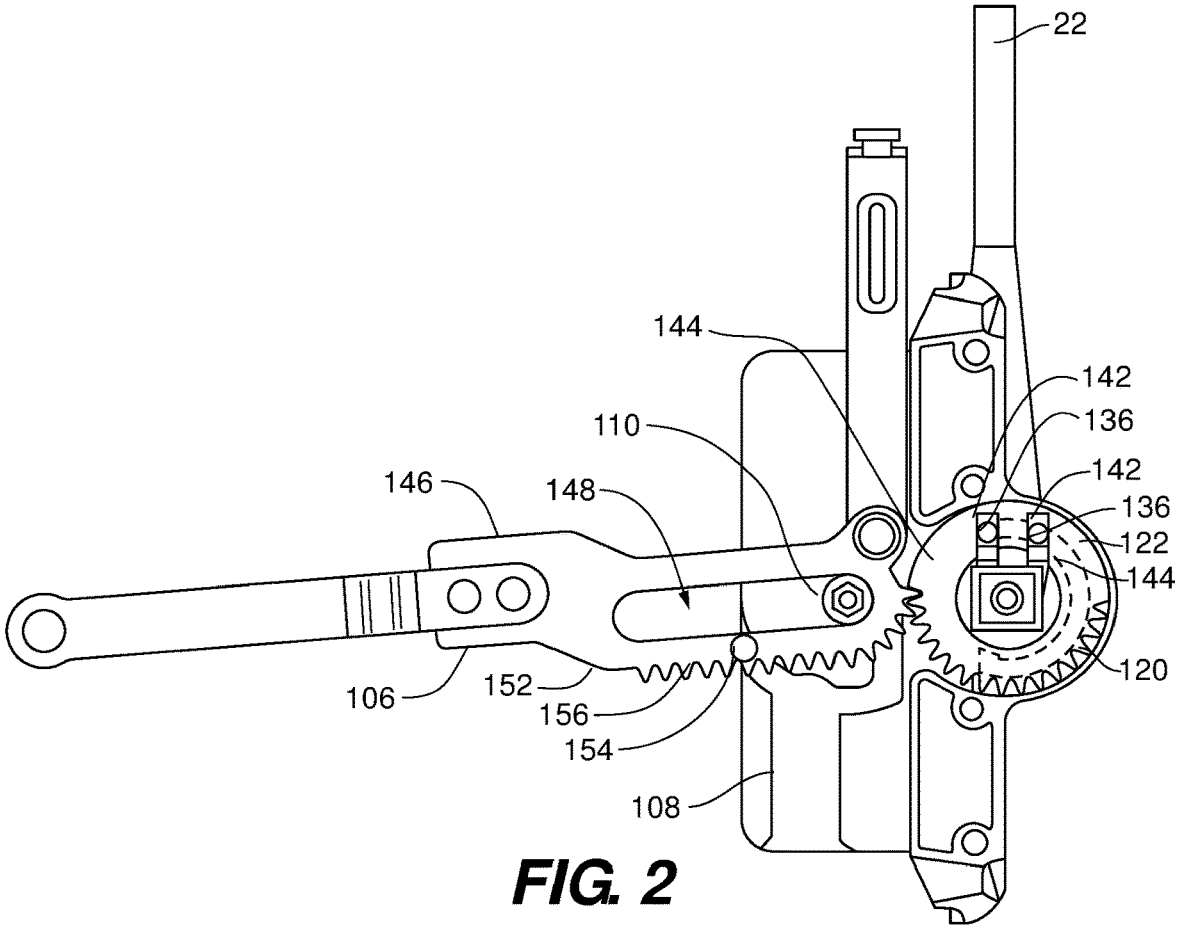
FIG. 2 is a side elevation view of the integrated operator depicted in FIG. 1 in a window open position.
Figure 3:
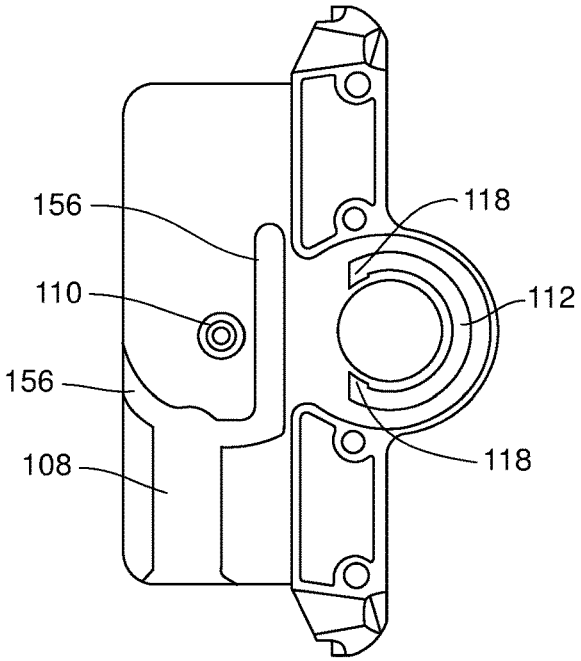
FIG. 3 is a side elevation view of a portion of the housing of the integrated operator depicted in FIG. 1.
Figure 4:
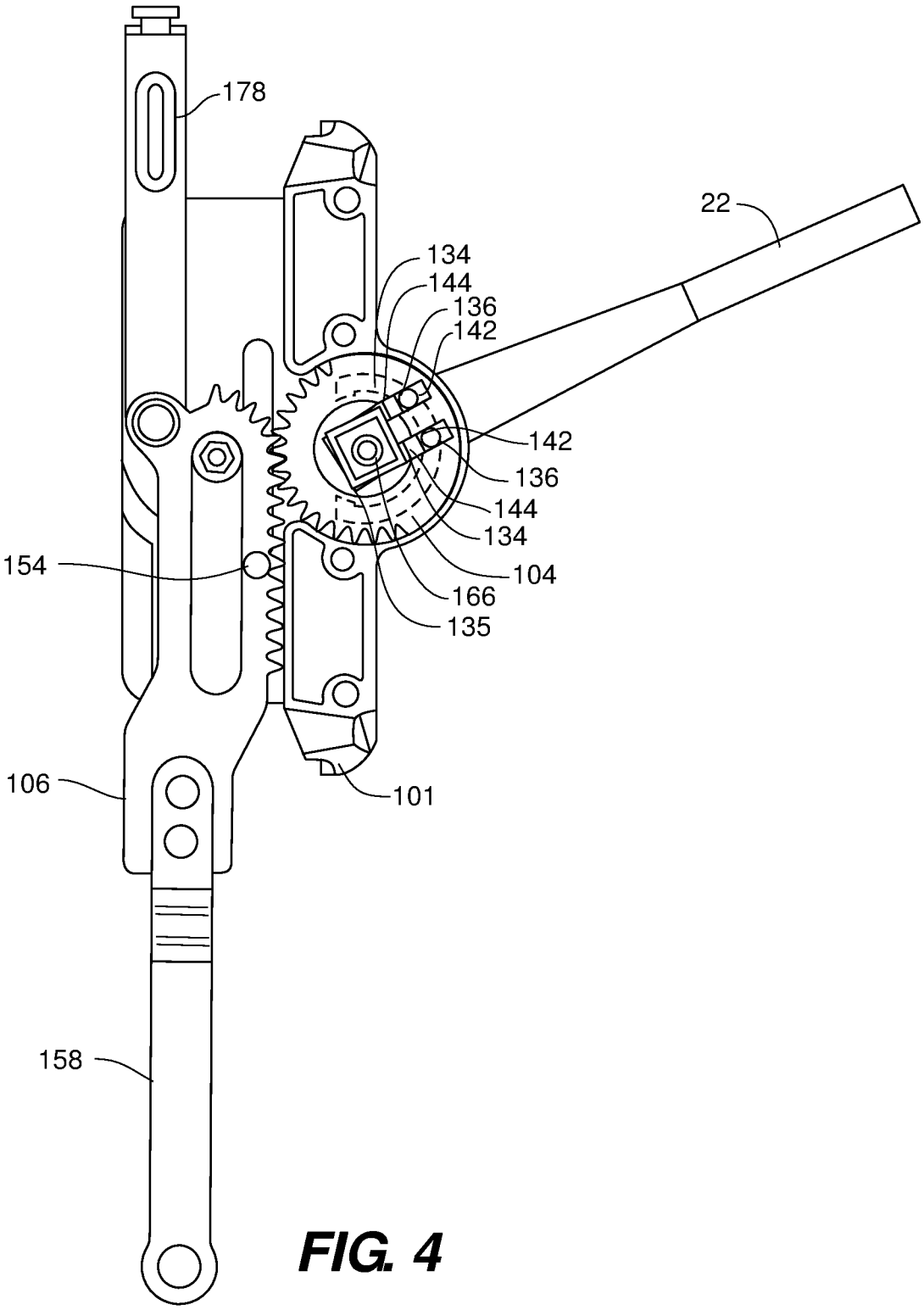
FIG. 4 is a side elevation view of the integrated operator of FIG. 1 in a window closed position with the gear portion free to rotate.
Figure 8:
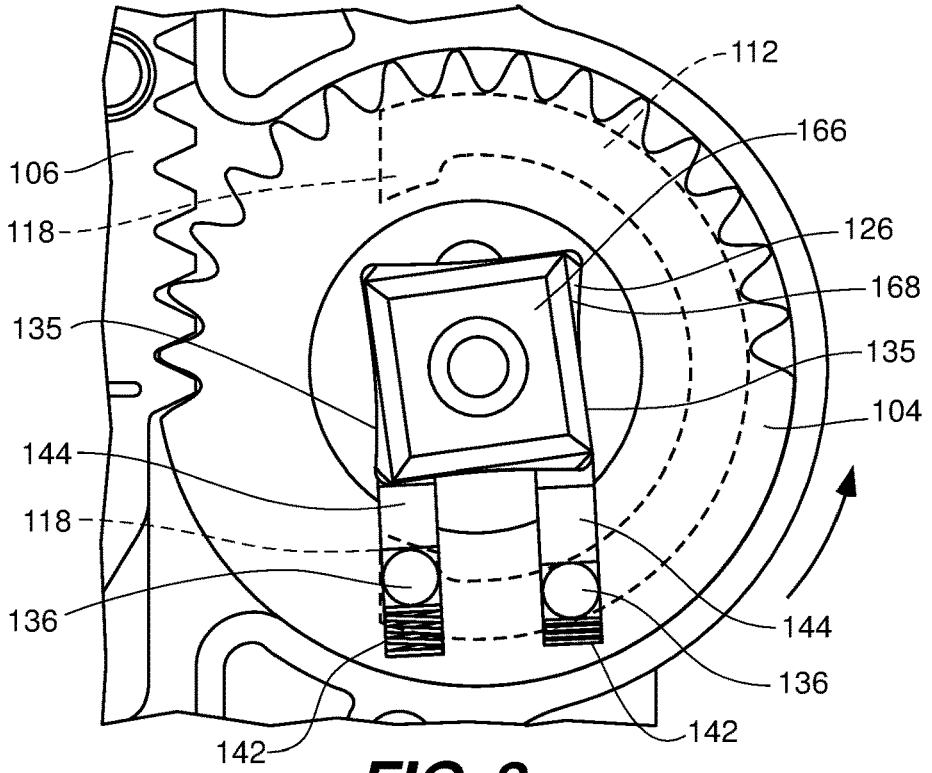
FIG. 8 is a side elevation view of the gear portion of the integrated operator of FIG. 1 with the anti-back-drive mechanism disengaged.
Figure 9:
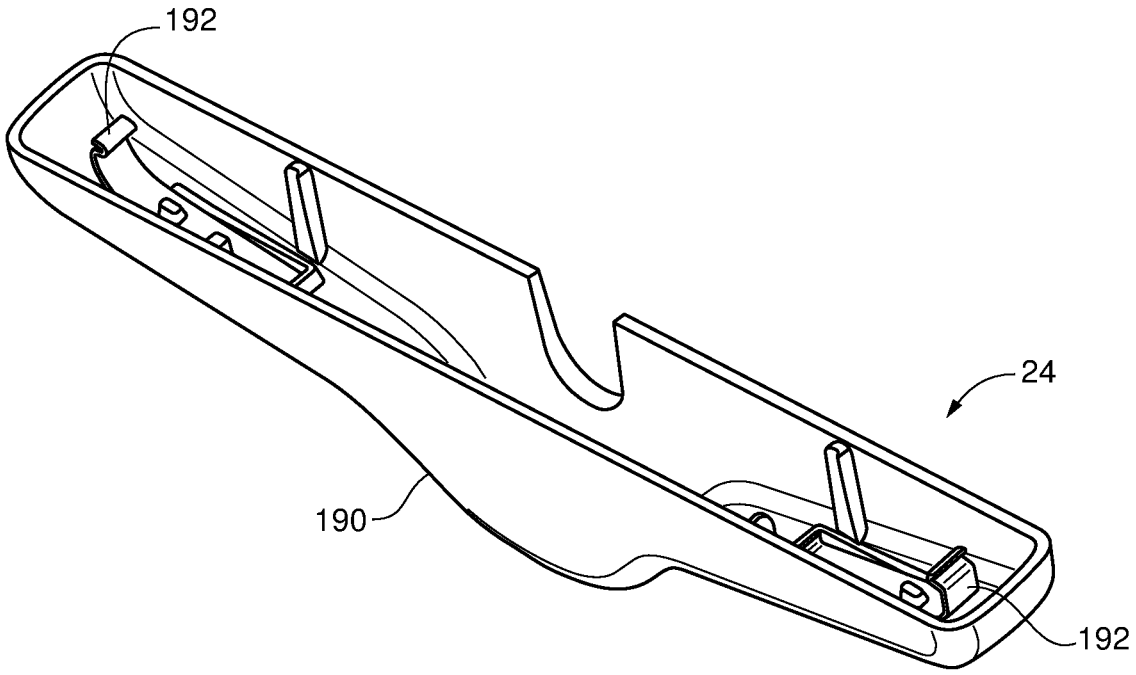
FIG. 9 is an isometric view of the rear side of the cover of the integrated operator of FIG. 1.
Figure 10:
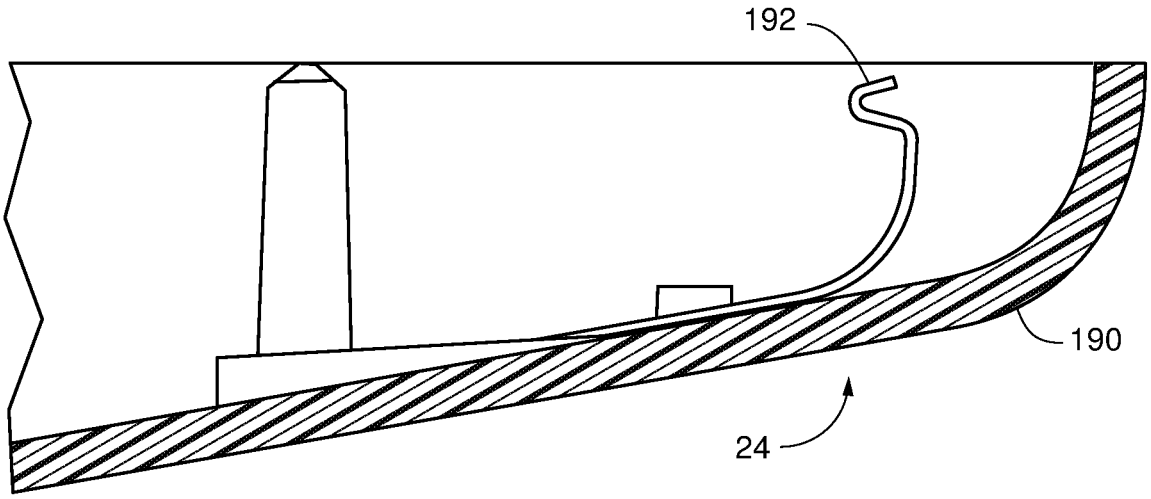
FIG. 10 is a partial side sectional view of the cover of the integrated operator depicted in FIG. 9.
Figure 11:
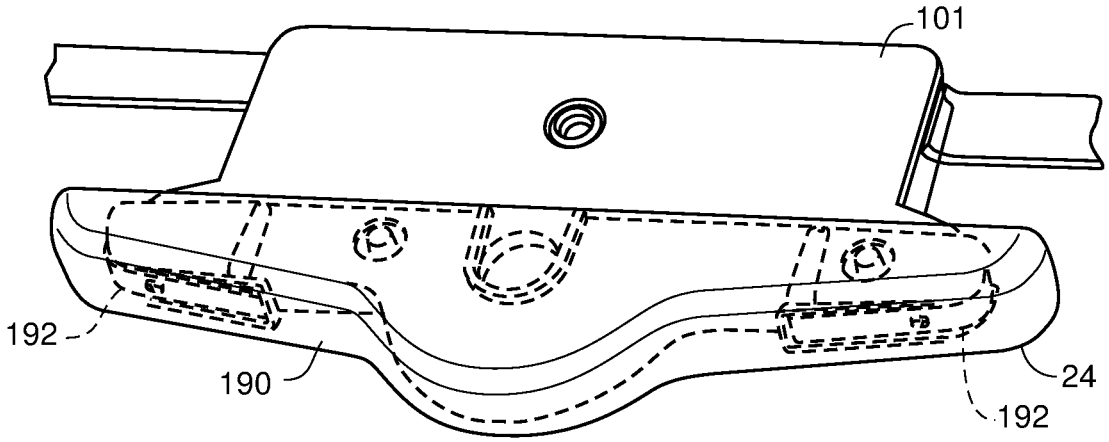
FIG. 11 is an isometric view of the integrated operator of FIG. 1 with the cover depicted in phantom.
Figure 12:
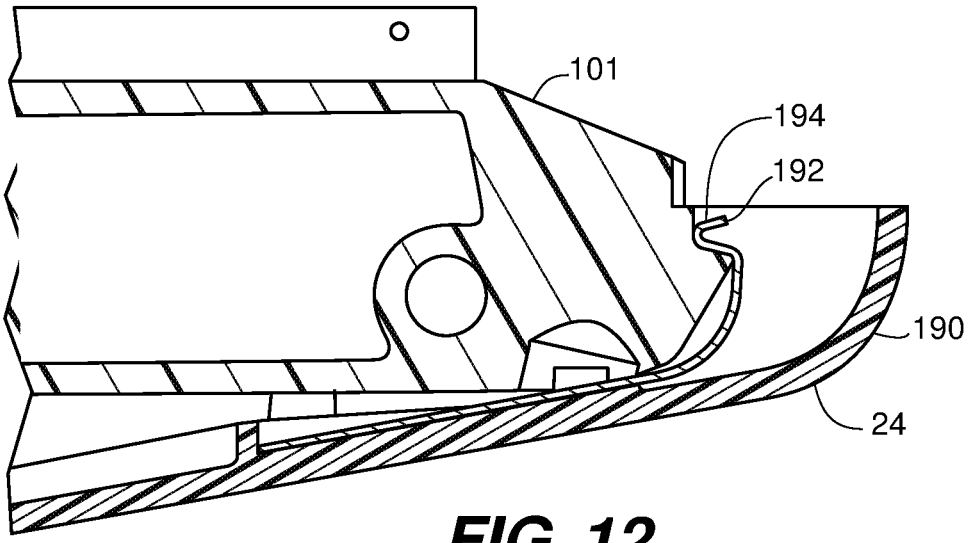
FIG. 12 is a partial sectional view of the integrated operator of FIG. 11 depicting the engagement of the cover with the housing.
Figure 13:
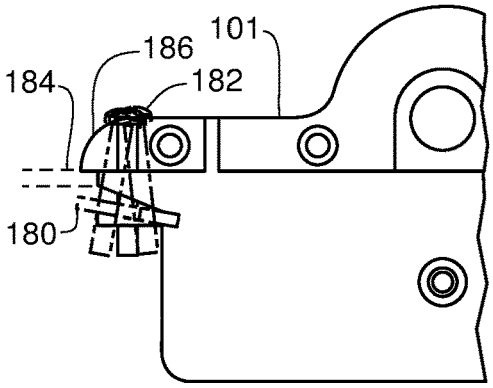
FIG. 13 is a partial side elevation view of the integrated operator of FIG. 1 depicting the engagement of the housing with a window profile.

When handle 22 is rotated in a counter-clockwise direction as depicted in FIG. 8, square shaped shaft 166 rotates within star-shaped aperture 124 until a bearing face 166 contacts a bearing surface 135. Another bearing face 168 of shaft 166 bears against follower block 144 and urges anti-back-drive pin 136 out of notch 118 and into arc-shaped channel 112 against the bias of spring 142. As handle 22 is rotated further in the counter-clockwise direction, gear 104 rotates with anti-back-drive pins 136 riding in arc-shaped channel 112. As gear 104 rotates, arm assembly 106 is urged downwardly through the mesh of gear 104 with gear teeth 150. Once boss 162 emerges from channel 108, sash 16 is no longer locked within frame 14. As handle 22 is rotated further, and gear 104 reaches curved portion 170 of arm 106, arm 106 swings outwardly, guided by guide pin 154, as depicted in FIG. 2, urging sash 16 to an open position. When in the fully open position, the other of anti-back-drive pins 136 drops into the other of notches 118 urged by the other of springs 142, thereby preventing rotation of gear 104 until handle 22 is rotated in the clockwise direction. To close sash 16, the direction of rotation of handle 22 is reversed.

It will of course be appreciated that integrated operator and lock 12 may be mounted so as to reverse the direction of movement of arm 106 from downward to upward, and the direction of rotation of handle 22 from counter-clockwise to clockwise during the opening operation. Also, it will be appreciated that although a square handle shaft and star-shaped gear aperture are described hereinabove, the same principles and functional operation can be effected with other shapes of each. Also, auxiliary arm 178 can be coupled to arm 106 to effect operation of additional remote locking points.

Figure 14:
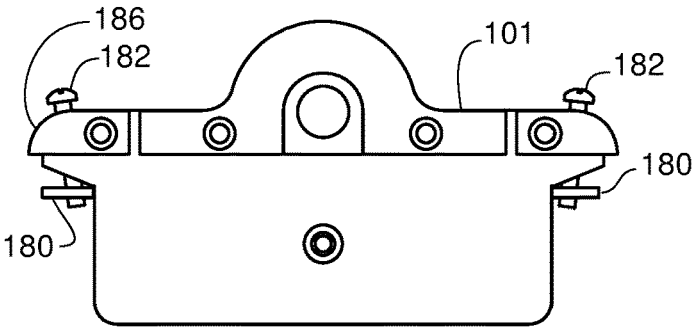
FIG. 14 is a partial side elevation view of the integrated operator of FIG. 1 depicting the engagement tabs of the housing in a retracted position.
Figure 15:
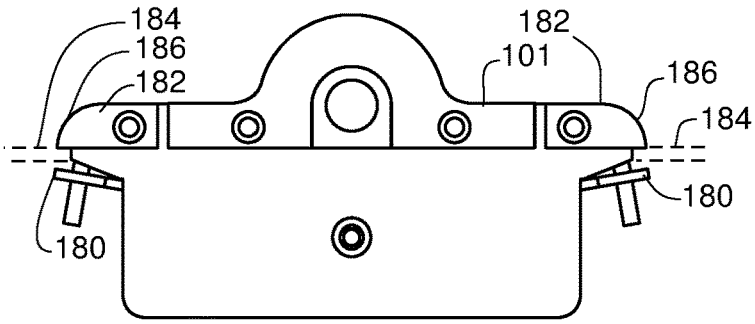
FIG. 15 is a partial side elevation view of the integrated operator of FIG. 1 depicting the engagement tabs of the housing in an extended position.
Figure 16:
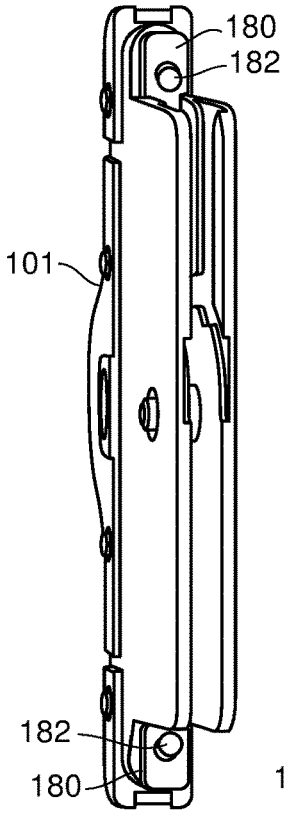
FIG. 16 is a rear isometric view of the integrated operator of FIG. 1 with the engagement tabs in a retracted position.
Figure 17:
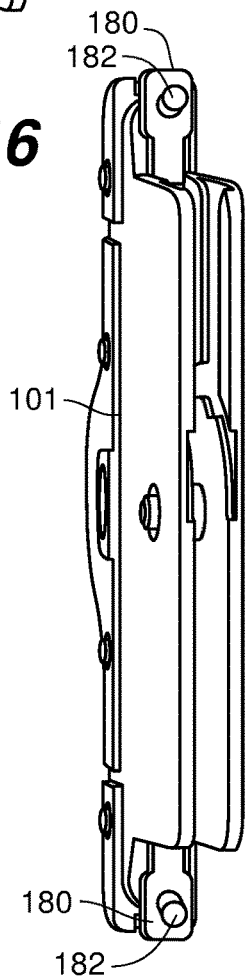
FIG. 17 is a rear isometric view of the integrated operator of FIG. 1 with the engagement tabs in an extended position.

Another feature of embodiments of the invention is depicted in FIGS. 13-17. In particular, housing 101 can be mounted in hollow member frame 14 by means of mounting tabs 180, driven by fasteners 182. With tabs 180 in a retracted position as depicted in FIG. 14, integrated operator and lock 12 can be inserted through an aperture cut in a hollow frame member. Once in place, fasteners 182 are tightened as depicted in FIG. 15, simultaneously extending and moving tabs 180 upward so as to clamp a wall 184 of hollow frame 14 between tab 180 and flange 186, thereby securing housing 101 in place. This feature increases the number of window profiles which the integrated operator and lock 12 will fit, from single wall aluminum profiles to vinyl profiles that have two walls that are spaced apart.

In FIGS. 9-12 a further feature of embodiments of the invention is depicted. In particular, snap-on cover 190 can be provided which has spring hooks 192. Spring hooks 192 can engage with notches 194 to enable cover 24 to snap on and off housing 101.

A further embodiment including an alternative anti-backdrive arrangement is depicted in FIGS. 24-35. In this embodiment, anti-backdrive assemblies 200 generally include follower blocks 202, anti-backdrive pins 204, and actuator rings 206, 208. Follower blocks 202 have wedge-shaped ends 210, and anti-backdrive pins 204 are carried in the opposite end of follower blocks 202. As described for the embodiments above, anti-backdrive assemblies 200 are received in slots 134 of gear 104, with anti-back-drive pins 204 extending outwardly from each face 138, 140, of gear 104 and riding in arc-shaped channel 112 of housing half 100 and/or housing half 102.

Figure 34:
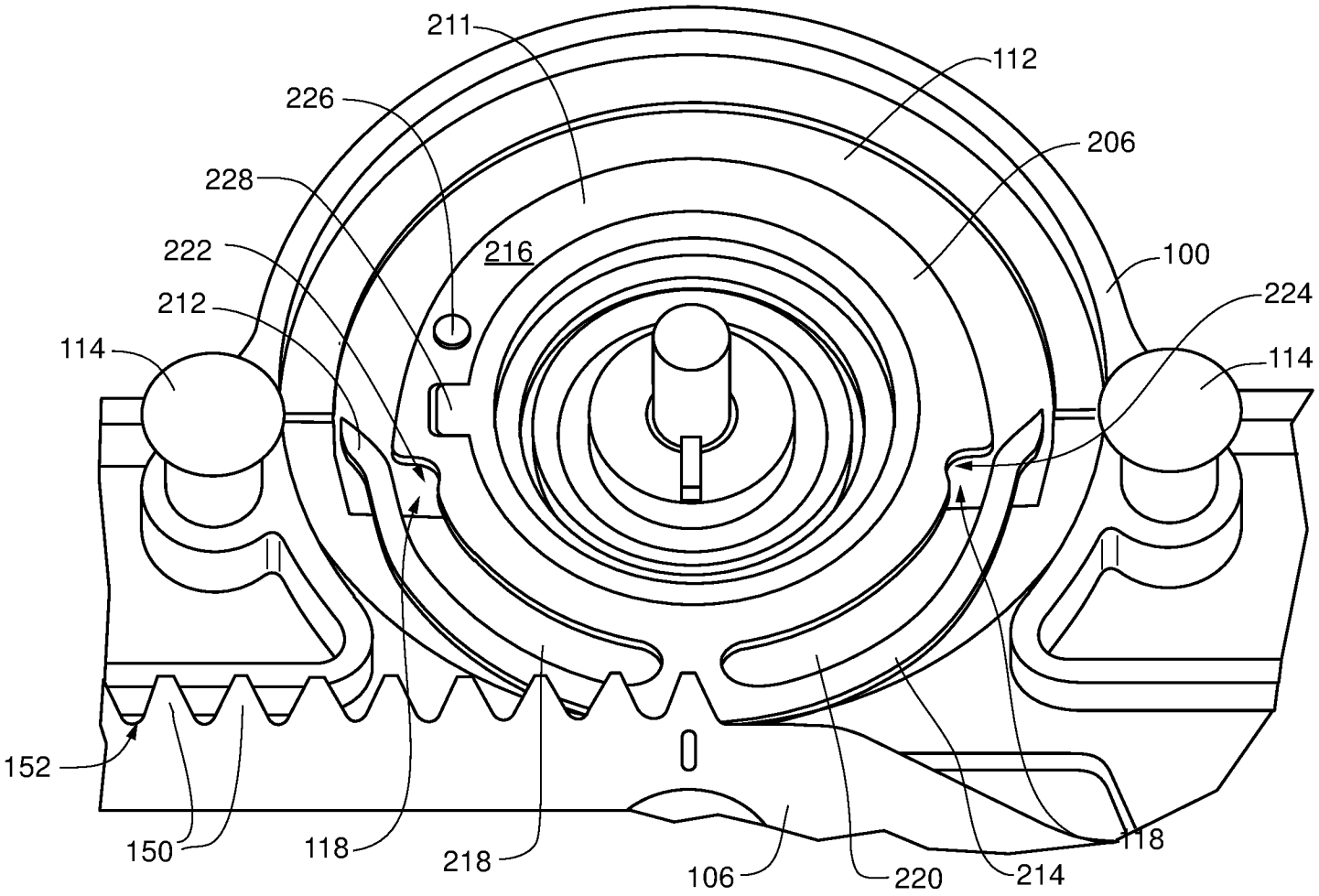
FIG. 34 is a partial isometric view of one of the housing halves of the embodiment of FIG. 24 with the gear omitted to show the actuating ring securement to the housing half.
Figure 35:
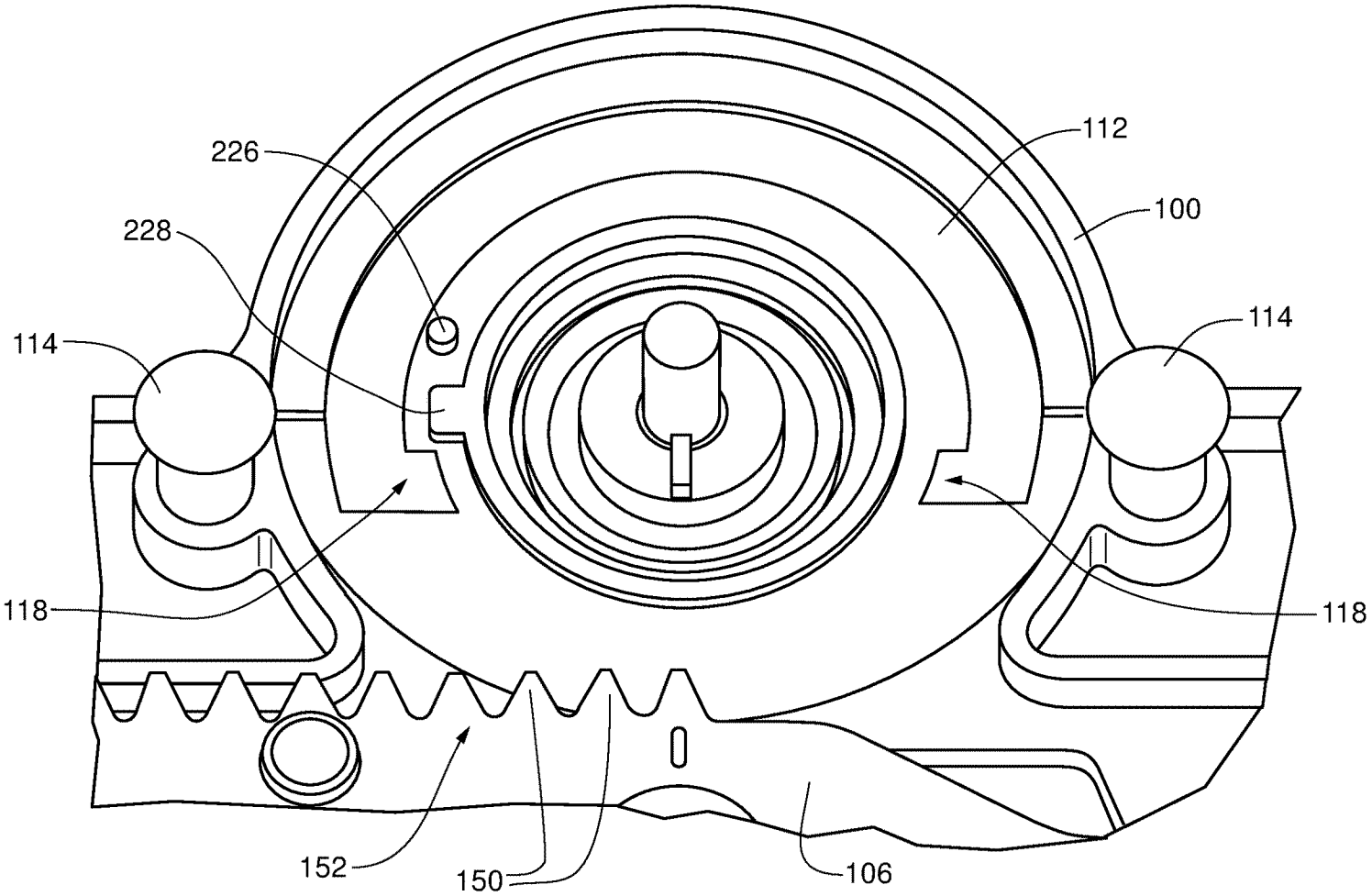
FIG. 35 is a partial isometric view of one of the housing halves of the embodiment of FIG. 24 with the gear and actuating ring omitted.

As best depicted in FIGS. 34 and 35, actuator rings 206, 208, generally include circular body portion 211, which defines a pair of opposing leaf spring arms 212, 214. Between each spring arm 212, 214, and inner body portion 216 are slots 218, 220, respectively with notches 222, 224, defined at the outer ends of the slots. Each actuator ring 206, 208, is fixed in rotational position relative to a respective housing half 100, 102, with boss 226 and indexing key 228.

Figure 26:
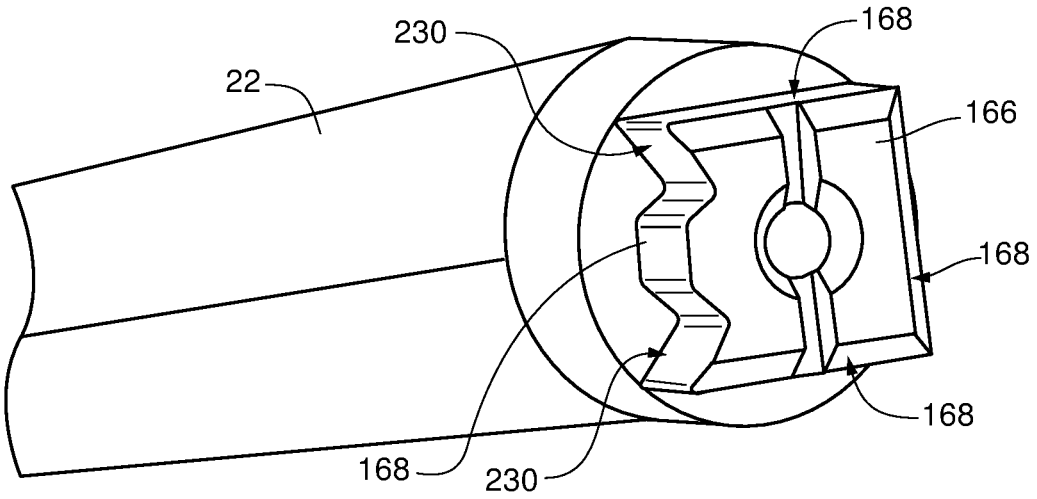
FIG. 26 is an isometric view of the handle shaft of the embodiment of FIG. 24
Figure 27:
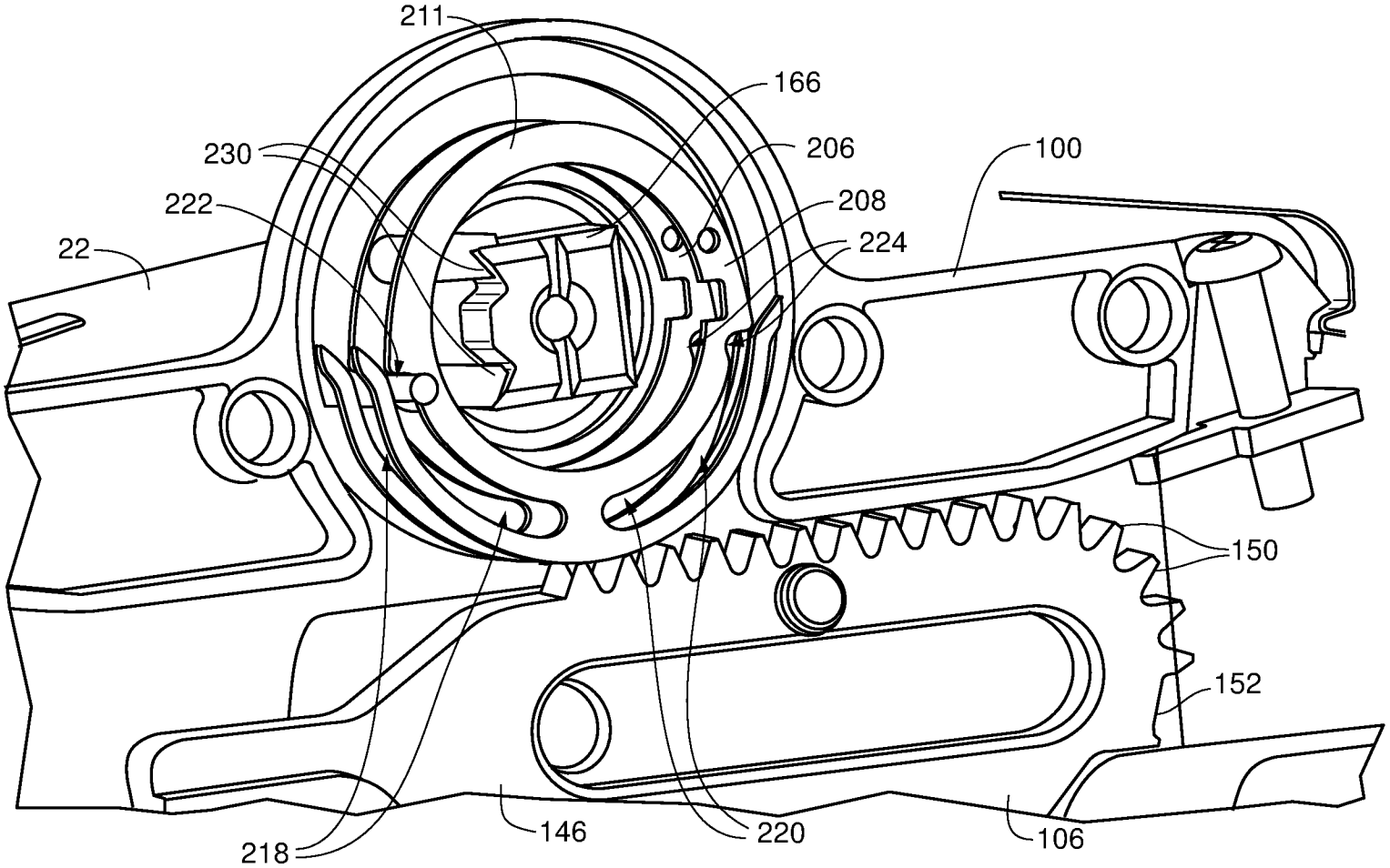
FIG. 27 is a partial isometric view of the embodiment of FIG. 24, with the gear portion omitted to show the actuating rings of the device.

In this embodiment, as depicted in FIGS. 26 and 27, square-shaped shaft 166 of handle 22 has notches 230 defined in one of bearing faces 168. Notches 230 are shaped to receive wedge-shaped ends 210 of follower blocks 202, and to facilitate shifting of follower blocks 202 as further described below.

Figure 28:
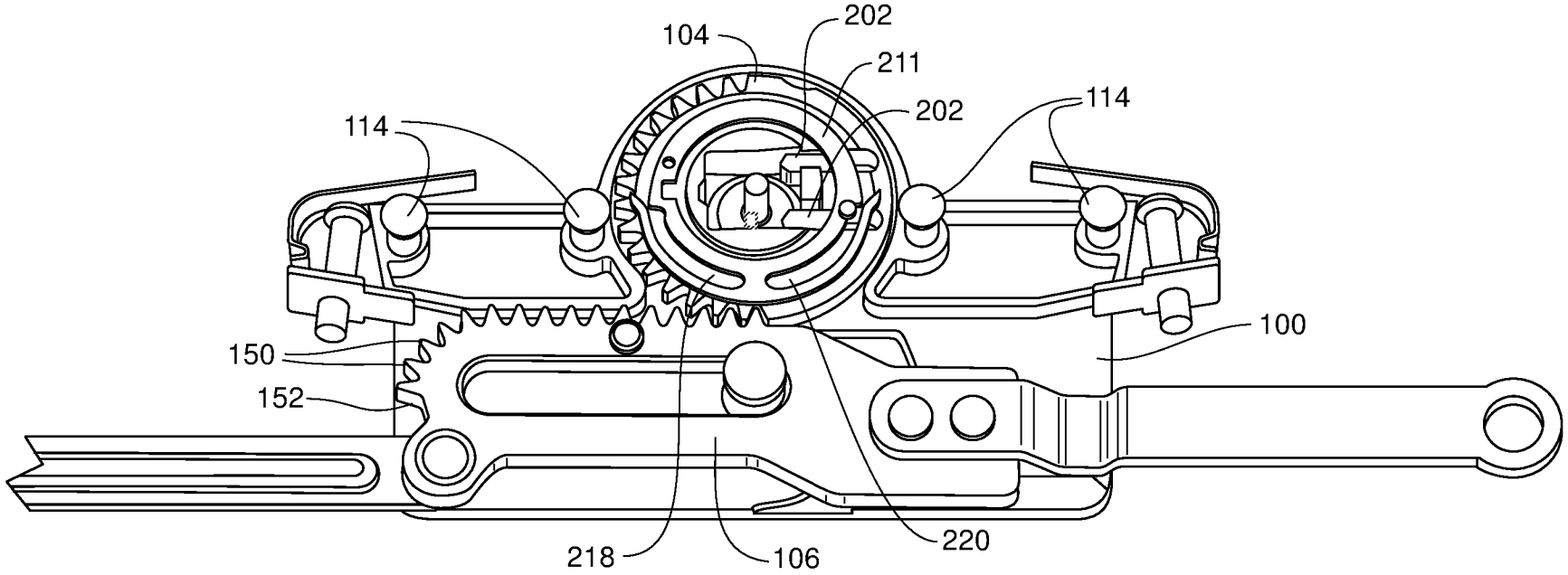
FIG. 28 is a partial isometric view of the embodiment of FIG. 24 depicted in the window closed and locked position.
Figure 29:
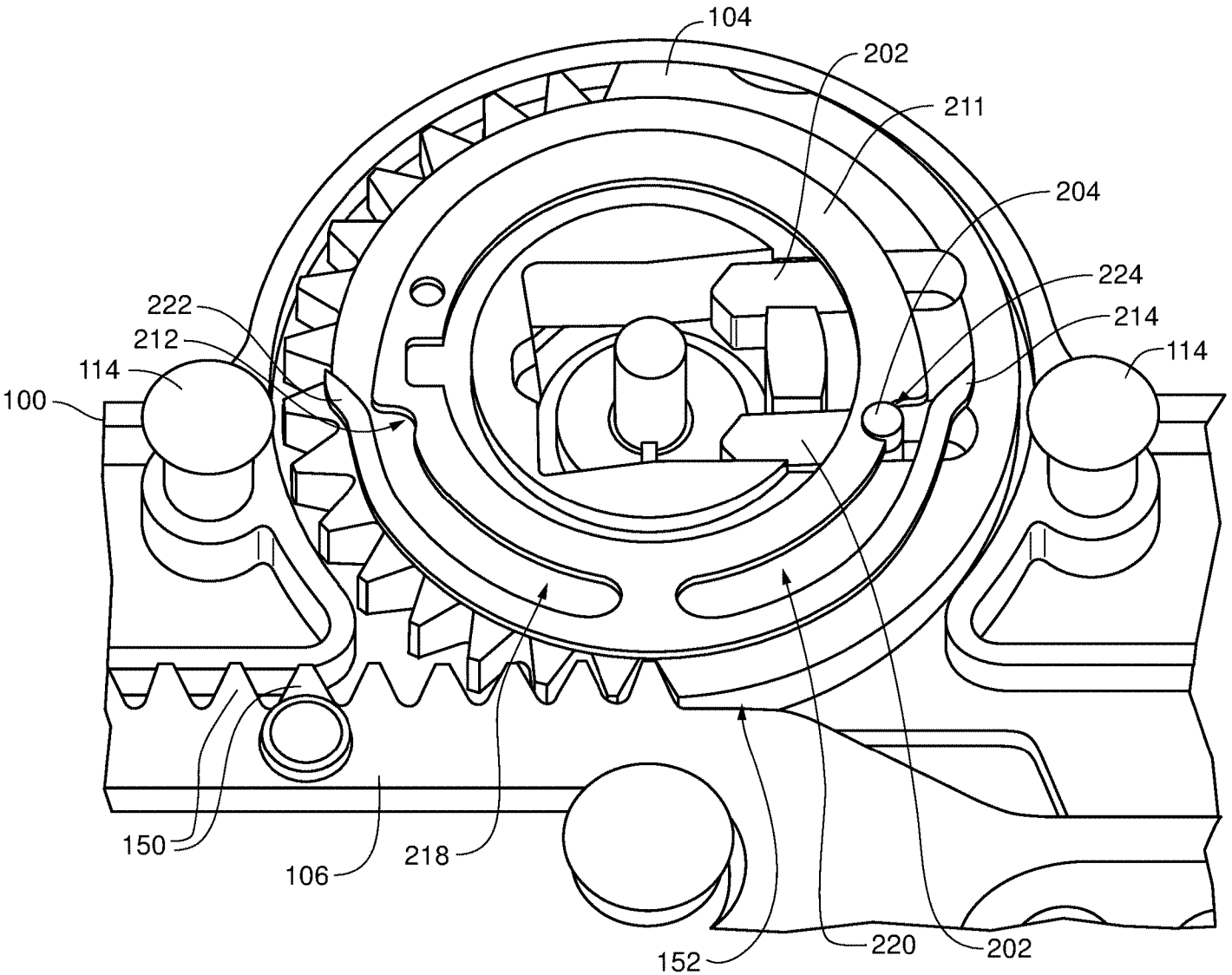
FIG. 29 is a close up view of the gear portion of the mechanism depicted in FIG. 28.

In use, with the integrated operator in the closed and locked position as depicted in FIGS. 28 and 29, spring arm 214 urges one of the anti-backdrive pins 204 into notches 224 and 118, thereby engaging wedge-shaped end 210 of the coupled follower block 202 into one of the notches 230 in square-shaped shaft 166 of handle 22. In this position, arm assembly 106 cannot be back-driven to rotate handle 22, and thereby unlock and open the window, since the anti-backdrive pin 204 is held in both notches 224 and 118 against rotation and is urged into engagement therewith by spring arm 214.

Figure 30:
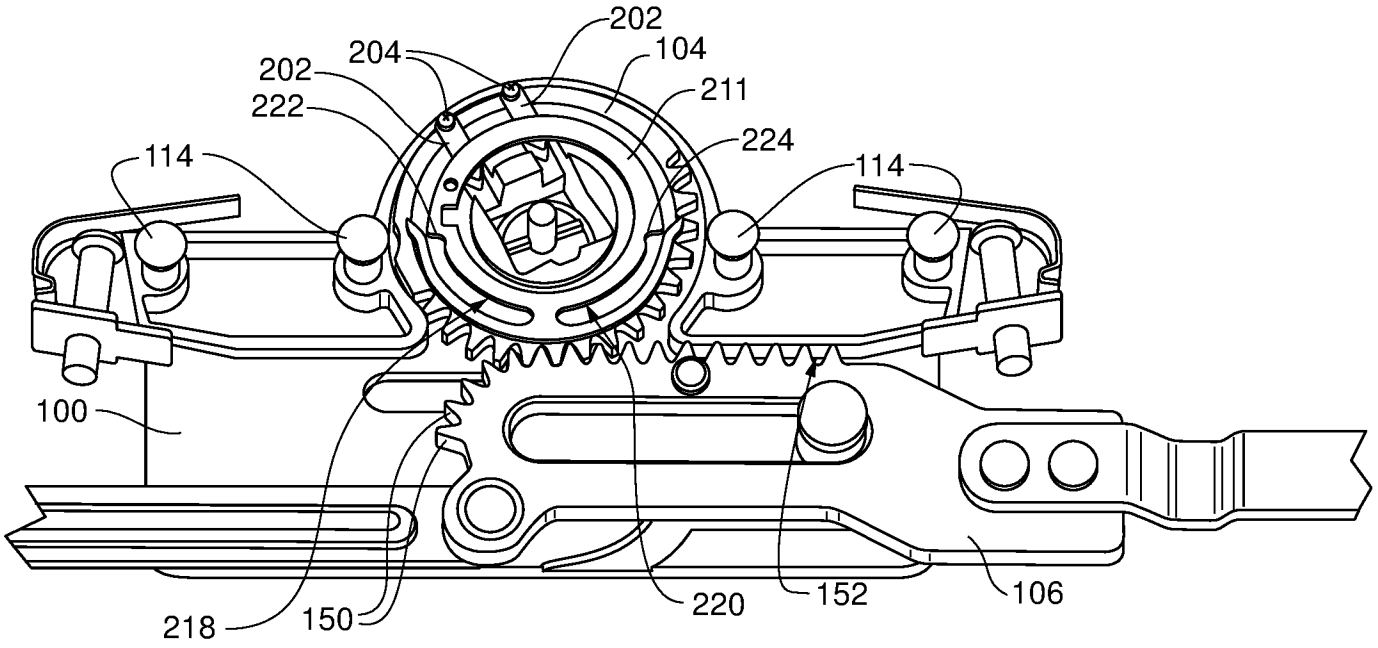
FIG. 30 is a partial isometric view of the embodiment of FIG. 24 depicted in the window closed and unlocked position.
Figure 31:
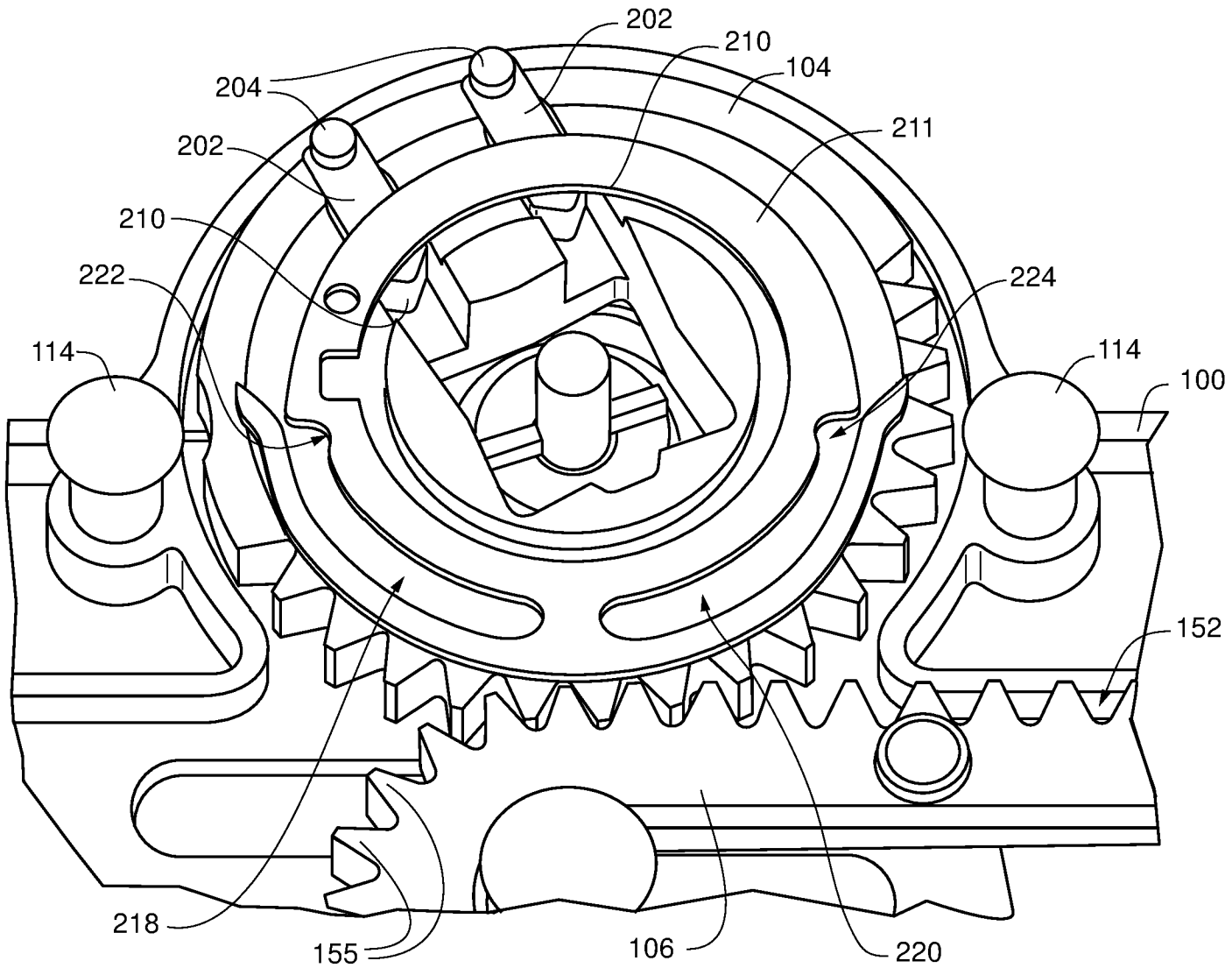
FIG. 31 is a close up view of the gear portion of the mechanism depicted in FIG. 30.

From this position, as depicted in FIGS. 30 and 31, when handle 22 is rotated counter-clockwise relative to the figures, wedge-shaped end 210 slides along the tapered surfaces of notch 230, thereby urging follower block 202 outward against the bias of spring arm 214. Accordingly, anti-backdrive pin 204 is shifted out of engagement with notches 224 and 118 and into arc-shaped channel 112, where the handle and mechanism can be freely shifted in either direction with handle 22.

Figure 32:
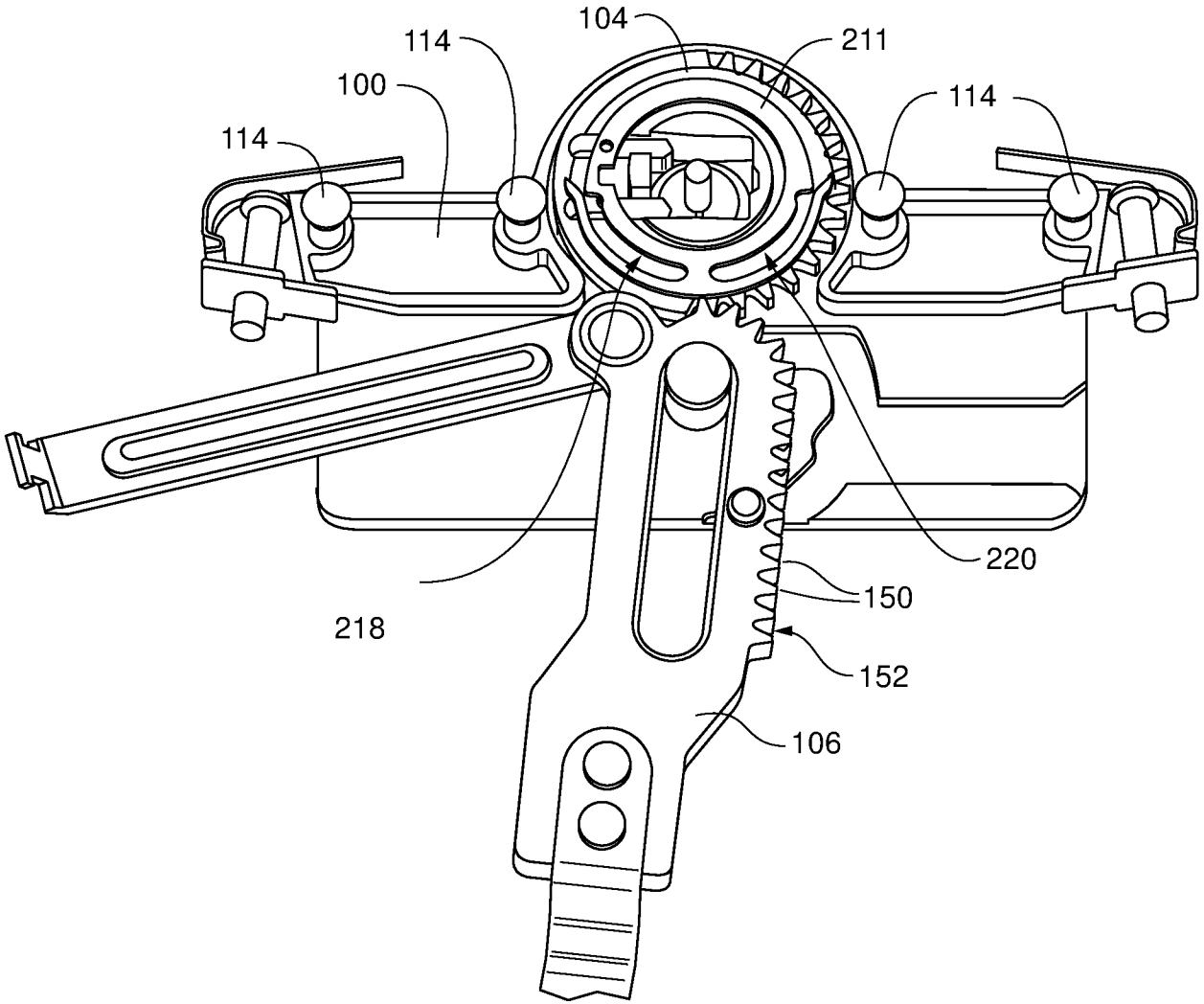
FIG. 32 is a partial isometric view of the embodiment of FIG. 24 depicted in the window open and secured in place by the anti-backdrive pins.
Figure 33:
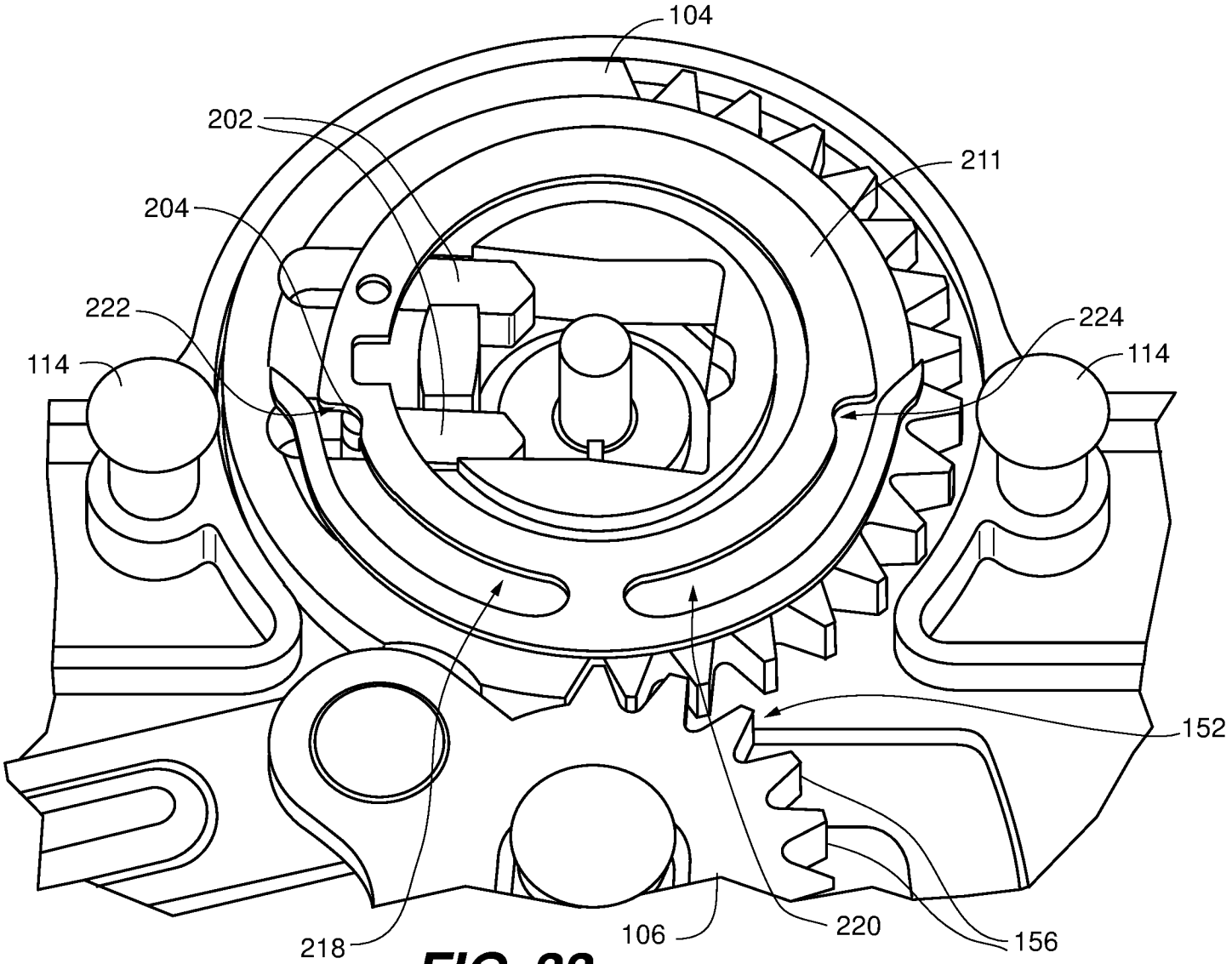
FIG. 33 is a close up view of the gear portion of the mechanism depicted in FIG. 32.

As depicted in FIGS. 32 and 33, further counter-clockwise rotation of handle 22 will cause arm assembly 106 to swing outward, thereby opening sash 16 of casement window 10, and will cause the other of anti-backdrive pins 204 to contact and thereby be guided and urged by spring arm 212 into engagement with notch 222 and notch 118 at the other end of arc-shaped channel 112. In this position, arm assembly 106 cannot be back-driven by wind or other forces to rotate handle 22, since the anti-backdrive pin 204 is held in both notches 222 and 118 and is urged into engagement therewith by spring arm 212. When it is desired to close casement window 10, handle 22 can be rotated clockwise, thereby reversing the sequence described above.

Advantages of various embodiments of the invention can be as follows:

- A positive detent provided by the anti-backdrive pin assemblies in the window open and closed positions can provide an audible click when the operator is in the fully open position and in the fully closed and locked position.
- The anti-backdriving feature can prevent wind buffeting from slamming the window shut when the device is in the fully open position.
- The described mounting method enables the operator to be applied to a wide variety of window profiles.
- The described mounting method enables screws to be driven into a window from the same side as the operator is installed in the cut out.
- The described mounting method enables access to the screw heads in the case of a hardware failure where the window has become stuck shut without cutting into the window frame profile.
- The lock-up feature within the body of the operator rather than a hook on the gear arm and lug on bracket reduces chance of the keeper missing the securing lug.
- The lock-up feature within the body of the operator rather than the hook on the gear arm and lug on bracket means operator fits wider variety of window profiles.
- The cover and handle can be removable for easy change of aesthetics, and the cover can snap on and off without tools.
- Handle is screwed on using standard fastener which holds the handle tighter, with less slop, than a spring.
- The anti-backdrive feature works in both directions. It prevents unauthorized entry in the locked position and also keeps the window from slamming shut in the open position, as for example due to wind.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. An integrated casement window operator and lock, comprising:

a gear mechanism, the gear mechanism including a housing, a pinion gear rotatably mounted to the housing, and an arm assembly including an arm and a sash interface link, the arm defining a rack portion and an adjacent arcuate gear portion, the arm slidably and rotatably mounted to the housing with the pinion gear engaged with the rack portion and the arcuate gear portion, the pinion gear defining a star-shaped aperture therethrough, the star-shaped aperture defined by a plurality of inwardly facing surfaces, each of the inwardly facing surfaces comprising a pair of bearing surfaces, on opposite sides of a central ridge, the pinion gear further defining a pair of spaced-apart slots, the slots extending outwardly from a separate one of the pair of hearing surfaces of one of the inwardly facing surfaces, the housing defining an arc-shaped slot with notches at opposing ends of the arc-shaped slot;

a pair of anti-backdrive pin assemblies, each of the anti-backdrive pin assemblies slidably disposed in a separate one of the spaced-apart slots of the pinion gear and including an anti-backdrive pin, each of the anti-backdrive pins engaged in the arc-shaped slot; and a handle defining a square-shaped shaft portion, the square-shaped shaft portion received in the star-shaped aperture of the pinion gear, wherein the handle is selectively movable to rotate the pinion gear such that the arm is shifted between a window fully closed position and a window fully open position, wherein when the arm is in the fully closed position, the pin of a first one of the pair of anti-backdrive pin assemblies is engaged in one of the notches of the arc-shaped slot to inhibit backdriving of the arm, and when the arm is in the fully open position, the pin of a second one of the pair of anti-backdrive pin assemblies is engaged in the other one of the notches of the arc-shaped slot to inhibit backdriving of the arm, the square-shaped shaft portion of the handle being rotatable in the star-shaped aperture of the pinion gear to shift the anti-backdrive assemblies out of engagement with the notches.

2. The integrated casement window operator and lock of claim 1, further comprising at least one biasing spring arranged to urge the anti-backdrive pins into engagement with the notches.

3. The integrated casement window operator and lock of claim 2, wherein the at least one biasing spring comprises a leaf spring.

4. The integrated casement window operator and lock of claim 1, further comprising a pair of biasing springs arranged to urge the anti-backdrive pins into engagement with the notches.

5. The integrated casement window operator and lock of claim 4, wherein each one of the pair of biasing springs comprises a coil spring.

6. The integrated casement window operator and lock of claim 4, wherein the pair of biasing springs are formed as a portion of an actuating ring.

7. The integrated casement window operator and lock of claim 1, wherein the anti-backdrive pin assemblies comprise a follower portion and a pin portion.

8. The integrated casement window operator and lock of claim 7, wherein the follower portion defines a wedge-shaped end.

9. The integrated casement window operator and lock of claim 8, wherein the square-shaped shaft portion of the handle defines four faces, one of the four faces defining a pair of spaced apart notches, the wedge-shaped ends of the follower portions being engageable in the notches in the face.

10. The integrated casement window operator and lock of claim 1, further comprising a cover.

11. A casement window, comprising:

a frame defining an opening;

a sash received in the frame and hinged to the frame to selectively close the opening; and a window operator and lock, the window operator and lock comprising:

a gear mechanism, the gear mechanism including a housing, a pinion gear rotatably mounted to the housing, and an arm assembly including an arm and a sash interface link, the arm defining a rack portion and an adjacent arcuate gear portion, the arm slidably and rotatably mounted to the housing with the pinion gear engaged with the rack portion and the arcuate gear portion, the pinion gear defining a star-shaped aperture therethrough, the star-shaped aperture defined by a plurality of inwardly facing surfaces, each of the inwardly facing surfaces comprising a pair of bearing surfaces on opposite sides of a central ridge, the pinion gear further defining a pair of spaced-apart slots, the slots extending, outwardly from a separate one of the pair of bearing surfaces of one of the inwardly facing surfaces, the housing defining an arc-shaped slot with notches at opposing ends of the arc-shaped slot;

a pair of anti-backdrive pin assemblies, each of the anti-backdrive pin assemblies slidably disposed in a separate cane of the spaced-apart slots of the pinion gear and including an anti-backdrive pin, each of the anti-backdrive pins engaged in the arc-shaped slot; and a handle defining a square-shaped shaft portion, the square-shaped shaft portion received in the star-shaped aperture of the pinion gear, wherein the handle is selectively movable to rotate the pinion gear such that the arm is shifted between a window fully closed position and a window fully open position, wherein when the arm is in the fully closed position, the pin of a first one of the pair of anti-backdrive pin assemblies is engaged in one of the notches of the arc-shaped slot to inhibit backdriving of the arm, and when the arm is in the fully open position, the pin of a second one of the pair of anti-backdrive pin assemblies is engaged in the other one of the notches of the arc-shaped slot to inhibit backdriving of the arm, the square-shaped shaft portion of the handle being rotatable in the star-shaped aperture of the pinion gear to shift the anti-backdrive assemblies out of engagement with the notches.

12. The casement window of claim 11, further comprising at least one biasing spring arranged to urge the anti-backdrive pins into engagement with the notches.

13. The casement window of claim 12, wherein the at least one biasing spring comprises a leaf spring.

14. The casement window of claim 11, further comprising a pair of biasing springs arranged to urge the anti-backdrive pins into engagement with the notches.

15. The casement window of claim 14, wherein each one of the pair of biasing springs comprises a coil spring.

16. The casement window of claim 14, wherein the pair of biasing springs are formed as a portion of an actuating ring.

17. The casement window of claim 11, wherein the anti-backdrive pin assemblies comprise a follower portion and a pin portion.

18. The casement window of claim 17, wherein the follower portion defines a wedge-shaped end.

19. The casement window of claim 18, wherein the square-shaped shaft portion of the handle defines four faces, one of the four faces defining a pair of spaced apart notches, the wedge-shaped ends of the follower portions being engageable in the notches in the face.

20. The casement window of claim 11, further comprising a cover.

* * * * *